US006847284B2

(12) United States Patent
Gamou et al.

(10) Patent No.: US 6,847,284 B2
(45) Date of Patent: Jan. 25, 2005

(54) PLANAR COIL AND PLANAR TRANSFORMER

(75) Inventors: Masahiro Gamou, Tokyo (JP); Satoshi Horikami, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/297,801

(22) PCT Filed: Feb. 28, 2002

(86) PCT No.: PCT/JP02/01842

§ 371 (c)(1),
(2), (4) Date: Dec. 10, 2002

(87) PCT Pub. No.: WO02/071422

PCT Pub. Date: Sep. 12, 2002

(65) Prior Publication Data

US 2003/0179067 A1 Sep. 25, 2003

(30) Foreign Application Priority Data

Mar. 5, 2001 (JP) ..... 2001-60731
Mar. 16, 2001 (JP) ..... 2001-75651

(51) Int. Cl.[7] ..... H01F 27/28

(52) U.S. Cl. ..... 336/223; 336/200; 336/232; 336/192; 336/83

(58) Field of Search ..... 336/223, 200, 336/192, 83, 65, 196, 232, 198; 29/602.1

(56) References Cited

U.S. PATENT DOCUMENTS 5,179,365 A 1/1993 Raggi
6,429,763 B1 * 8/2002 Patel et al. ..... 336/200

FOREIGN PATENT DOCUMENTS

| | | | |
|---|---|---|---|
| EP | 1 085 538 A1 | | 3/2001 |
| JP | A 4-113605 | | 4/1992 |
| JP | A 5-226155 | | 9/1993 |
| JP | A 7-37728 | | 2/1995 |
| JP | A 10-163039 | | 6/1998 |
| JP | A 11-307366 | | 11/1999 |
| JP | A 2001-85230 | | 3/2001 |
| JP | 2001-85230 | * | 3/2001 |

* cited by examiner

*Primary Examiner*—Lincoln Donovan
*Assistant Examiner*—Jennifer A. Poker
(74) *Attorney, Agent, or Firm*—Oliff & Berridge, PLC

(57) ABSTRACT

A planar coil includes a winding of N turns (N is an integer greater than or equal to 2). Letting $r_i(n)$ be a radius of an inner circumference of a winding portion at the $n^{th}$ turn (n is an integer greater than or equal to 1 and less than or equal to N) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (1) when the $r_{min}$, $W_{totla}$ and D are given.

$$A = \sum_{n=1}^{N} \left(\log \frac{r_o(n)}{r_i(n)}\right)^{-1} \quad (1)$$

10 Claims, 25 Drawing Sheets

PLANAR COIL AND PLANAR TRANSFORMER

TECHNICAL FIELD

The present invention relates to a planar coil and a planar transformer which have a winding that is formed by arranging a plate-like conductor into a flat-spiral shape.

BACKGROUND ART

Planar coils and planar transformers are used as choke coils and transformers in switching power supplies and the like. The planar coils and planar transformers have a winding made of a patterned conductor that is formed by arranging a plate-like conductor into a flat-spiral shape. In the planar transformers, or the planar coils having a plurality of windings, the windings are stacked in a direction of thickness, with an insulating layer interposed between adjacent ones of the windings.

Among the planar coils and planar transformers, the ones that deliver relatively small output currents are formed by, for example, stacking a flat-spiral-shaped patterned conductor, an insulating layer, and a magnetic layer by thin-film forming techniques such as sputtering. On the other hand, for the ones that deliver medium output currents, employed are: printed coils formed by stacking double-sided printed circuit boards with an insulating layer interposed therebetween, in which flat-spiral-shaped patterned conductors are formed on both surfaces of each printed circuit board by etching conductor layers disposed on both surfaces of the same; or coils formed by stacking flat-spiral-shaped patterned conductors with an insulating layer interposed therebetween, the patterned conductors being formed by die-cutting a conductor plate. Those coils have a hole penetrating therethrough in a direction of thickness at a center portion of the patterned conductors. A magnetic substance such as an EE-type ferrite core is inserted in the hole.

Since such planar coils and planar transformers as mentioned above can be formed to have a smaller thickness, they are used for a compact and thin switching power supply and so on, in particular.

In recent years, because of decreased operating voltages and increased currents in ICs (Integrated Circuits) resulting from an increase in their scale of integration, it has been desired that a switching power supply be reduced in size and provide a large current. A loss caused by the resistance of a conductor in choke coils or transformers, i.e., the copper loss, increases in proportion to the square of the value of the current. For this reason, it is significant to reduce the resistance value of conductors in the planar coils or planar transformers which are used as choke coils or transformers.

Switching devices such as FETs (field effect transistors), one of major components of a switching power supply, have been reduced in both loss and size as the semiconductor technology has progressed. In contrast to this, it is difficult to reduce the size of magnetic components such as choke coils and transformers, the other major components of the switching power supply. For this reason, the ratio of the volume of the magnetic components to the volume of the entire switching power supply tends to increase. Although the magnetic components are under progress toward miniaturization, this depends largely on a fact that a switching frequency has become higher due to progress in the switching devices. If a higher switching frequency is achieved, it is possible to achieve a reduction in both size and loss of the core of the coil or the transformer. This, however, present a problem that the copper loss that is a loss in the conductor increases due to the skin effect.

Conventionally, most planar coils or planar transformers have a winding in which every per-turn portion is constant in width. However, in this case, resistance becomes higher at the outer portions of the winding, which consequently causes an increase in the resistance of the entire winding.

To cope with this, Published Unexamined Japanese Patent Application (KOKAI) Heisei 5-226155 discloses a technique of increasing the width of the winding of a coil with increasing distance from the center so that every portion of the winding has the same copper loss. In this technique, the width of each portion of the winding is determined by using complicated equations. Published Unexamined Japanese Patent Application (KOKAI) Heisei 7-37728 also discloses a technique of increasing the width of the winding of a coil with increasing distance from the center so that every portion of the winding has the same or substantially the same copper loss. In both of these techniques, a ratio between Ri and W, or Ri/W, where Ri represents the radius of an inner circumference of each per-turn portion of the winding and W represents the width of each per-turn portion of the winding, is made constant, thereby allowing the copper loss to be the same for every portion of the winding. This is intended to minimize the copper loss for the entire coil in a limited space.

However, it is not proved that the copper loss for the entire coil is minimized by making the Ri/W constant.

While the number of turns of the winding (the number of winding turns) in choke coils or transformers is determined in accordance with a ripple voltage and the input/output voltage ratio required of the switching power supply, and further with the power supply driving frequency, the shape and physical properties of the core, and so on, there are many cases in which an odd number of turns are required. Printed coils allow greater flexibility in design of windings as compared with coils employing wires. For example, for printed coils, it is possible to form a winding of a desired number of turns within a specific winding frame (or an area where to place a patterned conductor) by changing the width of the patterned conductor. Furthermore, for printed coils, a plurality of patterned conductors having the same pattern may be stacked and connected in parallel to each other using a through-hole or the like, thereby allowing adjustment of permissible current capacity.

Conventionally, for planar coils or planar transformers, the following four methods have been employed for forming a winding having an odd number of turns which is equal to or greater than three. A first method is to form the winding having a required odd number of turns by using one conductor layer that includes a patterned conductor of an odd number of turns. A second method is, as shown in, e.g., Published Unexamined Japanese Patent Application (KOKAI) Heisei 4-113605, to connect an odd number of conductor layers in series to each other, each of the conductor layers including a patterned conductor of one turn. A third method is to connect a conductor layer including a patterned conductor of an even number of turns and a conductor layer including a patterned conductor of an odd number of turns in series to each other. A fourth method is, as shown in FIG. 6 to FIG. 9 of Published Unexamined Japanese Patent Application (KOKAI) Heisei 10-163039, for example, to connect a conductor layer including a patterned conductor of the [even number+$\alpha$] number of turns (where $\alpha$ is greater than zero and less than one) and a conductor layer including a patterned conductor of the [even number+(1−α)] number of turns in series to each other.

However, the aforementioned methods have the following problems. In the first method, one of terminals of the winding needs to be drawn out from the neighborhood of an inner edge of the patterned conductor. For this reason, in the first method, it is impossible to use a core typically employed for planar coils, that is, a core in which a connecting portion that connects the portion penetrating the winding (the so-called middle foot) to the portions facing the outer circumference of the winding (the so-called outer feet) has such a great width as to cover most part of the winding. To employ the first method, it is necessary to use a core in which the aforementioned connecting portion is small in width so as not to contact with the terminal of the winding to be drawn out from the neighborhood of the inner edge of the patterned conductor. In this case, to secure a sufficient cross-sectional area of the core to avoid saturation of a magnetic flux, it is necessary to increase the thickness of the core. Thus, it is difficult for the first method to make the planar coils or planar transformers smaller in thickness.

In the second method, conductor layers as many as the number of turns required have to be stacked, which presents a problem that the planar coil or the planar transformer becomes greater in thickness. In addition, in the second method, connecting portions required for connecting an odd number of conductor layers in series to each other increase in number with increasing number of turns required. For example, forming a winding of five turns requires four connecting portions other than the terminals. This necessitates a wide area in the planar coil or the planar transformer for accommodating the connecting portions. Additionally, the second method allows a low degree of flexibility in designing the number of conductor layers because the number of conductor layers must coincide with the number of turns of the winding. For example, to form a winding of five turns, the number of conductor layers must be set in five-layer increments. In this case, for example, to increase the number of conductor layers so as to increase current capacity, the number of conductor layers can only be made equal to a multiple of five. It is therefore impossible to provide, for example, eight or twelve layers to achieve a desired current capacity.

For the third and fourth methods, the patterned conductors in the two conductor layers can be wound in directions opposite to each other to electrically connect the inner ends of the two patterned conductors to each other. This makes it possible to draw out the two terminals of the winding from the outer ends of the two patterned conductors. Thus, in the third and fourth methods, both terminals of the winding can be disposed outside the core, and this allows use of a core that is small in thickness and has a wide connecting portion between the middle foot and the outer feet. Furthermore, in the third and fourth methods, it is possible to design the number of conductor layers in two-layer increments, which allows a high degree of flexibility in designing the number of conductor layers.

Third and fourth methods, however, cause great differences between portions of the patterned conductor in width, resulting in variations of the current density from portion to portion of the winding. For this reason, the third and fourth methods cannot allow an optimum design of a patterned conductor from the viewpoint of reducing loss.

DISCLOSURE OF THE INVENTION

It is a first object of the invention to provide a planar coil and a planar transformer in which a winding is configured to minimize a loss in a limited space.

Additionally, it is a second object of the invention to provide a planar coil and a planar transformer having a winding of an odd number of turns and allowing a reduction in thickness, great flexibility in designing the number of conductor layers, and a reduction in loss.

A first planar coil of the invention comprises a winding formed by arranging a conductor into a flat-spiral shape, the winding including winding portions of N turns (N is an integer greater than or equal to two), wherein: letting $r_i(n)$ be a radius of an inner circumference of a winding portion at the $n^{th}$ turn (n is an integer greater than or equal to one and less than or equal to N) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (1) when the $r_{min}$, $W_{total}$ and D are given:

$$A = \sum_{n=1}^{N} \left(\log \frac{r_o(n)}{r_i(n)}\right)^{-1} \tag{1}$$

where $r_i(1)=r_{min}$, $r_i(n+1)-r_o(n)=D$, and $r_o(N)-r_i(1)=W_{total}$.

In the first planar coil of the invention, by setting the $r_i(n)$ and $r_o(n)$ so as to minimize the value of A given by the equation (1), the resistance value of the entire winding becomes minimum, which results in a minimized loss in the entire winding. In the present application, a winding portion refers to a portion of the entire winding, the portion corresponding to one turn.

In the first planar coil of the invention, a plurality of the windings may be provided, and the plurality of the windings may be stacked in a direction of thickness with an insulating layer disposed between adjacent ones, and connected in parallel or in series to each other.

A first planar transformer of the invention comprises a plurality of windings each formed into a flat shape and stacked in a direction of thickness, and an insulating layer disposed between adjacent ones of the windings, a part of the plurality of windings serving as a primary winding and another part of the plurality of windings serving as a secondary winding, wherein:

at least one of the plurality of windings includes winding portions of N turns (N is an integer greater than or equal to two), the winding portions being formed by arranging a conductor into a flat-spiral shape, and letting $r_i(n)$ be a radius of an inner circumference of a winding portion at the $n^{th}$ turn (n is an integer greater than or equal to one and less than or equal to N) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (1) when the $r_{min}$, $W_{total}$ and D are given:

$$A = \sum_{n=1}^{N} \left(\log \frac{r_o(n)}{r_i(n)}\right)^{-1} \quad (1)$$

where $r_i(1)=r_{min}$, $r_i(n+1)-r_o(n)=D$, and $r_o(N)-r_i(1)=W_{total}$.

In the first planar transformer of the invention, by setting the $r_i(n)$ and $r_o(n)$ so as to minimize the value of A given by the equation (1), the resistance value of the entire winding becomes minimum, which results in a minimized loss in the entire winding.

A second planar coil of the invention has a winding of an odd number of turns, the winding being formed of a conductor, the planar coil comprising: an insulating layer; a first conductor layer including a first patterned conductor formed by arranging a conductor into a flat-spiral shape; and a second conductor including a second patterned conductor formed by arranging a conductor into a flat-spiral shape, the second conductor layer being adjacent to the first conductor layer via the insulating layer, wherein:

the first patterned conductor and the second patterned conductor each have winding portions of N (N is an integer greater than or equal to one) plus one turns, and the innermost winding portions of the first and second patterned conductors are connected in parallel to each other, thereby allowing the first patterned conductor and the second patterned conductor to form the winding of 2N+1 turns.

In the second planar coil of the invention, the innermost winding portions of the first and second patterned conductors are connected in parallel to each other so as to form a conductive path corresponding to one turn of the winding. On the other hand, the other winding portions of the first and second patterned conductors form a conductive path corresponding to 2N turns. In the present invention, the first patterned conductor and the second patterned conductor may be formed into the same pattern in terms of width. In the present invention, the conductive path corresponding to one turn that is formed by the innermost winding portions of the first and second patterned conductors is twice as thick as the other conductive path. However, by adjusting the width thereof, it is possible to reduce the resistance value of the entire winding of 2N+1 turns, and to thereby reduce the loss of the entire winding. The present invention covers not only the case where the first conductor layer and the second conductor layer are adjacent to each other via the insulating layer, but also the case where the first conductor layer and the second conductor layer are adjacent to each other via the insulating layer and another layer.

In the second planar coil of the invention, the innermost winding portion of each of the first and second patterned conductors may have a width that is substantially half the width of another winding portion. In this case, the conductive path corresponding to one turn that is formed by the innermost winding portions of the first and second patterned conductors is twice as thick as the other conductive path. However, since the width thereof is substantially half that of the other conductive path, the cross-sectional area of the same is substantially equal to that of the other conductive path. Accordingly, a current density is uniformalized for every portion of the winding of 2N+1 turns, and a loss in the winding is thereby reduced.

In the present application, a winding portion refers to a portion of each patterned conductor, the portion corresponding to one turn. In addition, in the present application, "substantially half" is intended to include an exactly half value and also other values that contain tolerances, such as a rounding error in design or an error in manufacture, on the exactly half value.

In the second planar coil of the invention, in the first patterned conductor and the second patterned conductor, letting $r_i(n)$ be a radius of an inner circumference of a winding portion at the $n^{th}$ turn (n is an integer greater than or equal to 1 and less than or equal to N+1) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ may be determined so as to minimize a value of A expressed by equation (5) when the $r_{min}$, $W_{total}$ and D are given:

$$A = \sum_{n=1}^{N+1} K(n)\left(\log \frac{r_o(n)}{r_i(n)}\right)^{-1} \quad (5)$$

where $K(1)=0.5$; $K(n)=2$ when $n \geqq 2$; $r_i(1)=r_{min}$; $r_i(n+1)-r_o(n)=D$; and $r_o(N+1)-r_i(1)=W_{total}$.

In this way, by setting the $r_i(n)$ and $r_o(n)$ so as to minimize the value of A given by the equation (5), the resistance value of the entire winding becomes minimum, which results in a minimized loss in the entire winding.

In the second planar coil of the invention, a plurality of sets of the insulating layer, the first conductor layer and the second conductor layer may be stacked in a direction of thickness, with the windings of the respective sets connected in parallel to each other.

A second planar transformer of the invention has a primary winding and a secondary winding, each being formed of a conductor arranged into a flat shape, wherein:

at least one of the primary winding and the secondary winding comprises: a first conductor layer including a first patterned conductor formed by arranging a conductor into a flat-spiral shape; and a second conductor including a second patterned conductor formed by arranging a conductor into a flat-spiral shape, the second conductor layer being adjacent to the first conductor layer via an insulating layer, the first patterned conductor and the second patterned conductor each have winding portions of N (N is an integer greater than or equal to one) plus one turns, and the innermost winding portions of the first and second patterned conductors are connected in parallel to each other, thereby allowing the first patterned conductor and the second patterned conductor to form a winding of 2N+1 turns.

In the second planar transformer of the invention, the innermost winding portions of the first and second patterned conductors are connected in parallel to each other so as to form a conductive path corresponding to one turn of the winding. On the other hand, the other winding portions of the first and second patterned conductors form a conductive path corresponding to 2N turns. In the present invention, the first patterned conductor and the second patterned conductor may be formed into the same pattern in terms of width. In the present invention, the conductive path corresponding to one turn that is formed by the innermost winding portions of the first and second patterned conductors is twice as thick as the other conductive path. However, by adjusting the width thereof, it is possible to reduce the resistance value of the entire winding of 2N+1 turns, and to thereby reduce a loss in the entire winding. The present invention covers not only the case where the first conductor layer and the second conductor layer are adjacent to each other via the insulating layer, but also the case where the first conductor layer and the second conductor layer are adjacent to each other via the insulating layer and another layer.

In the second planar transformer of the invention, the innermost winding portion of each of the first and second patterned conductors may have a width that is substantially half the width of another winding portion. In this case, the conductive path corresponding to one turn that is formed by the innermost winding portions of the first and second patterned conductors is twice as thick as the other conductive path. However, since the width thereof is substantially half that of the other conductive path, the cross-sectional area of the same is substantially equal to that of the other conductive path. Accordingly, a current density is uniformalized for every portion of the winding of 2N+1 turns, and a loss in the winding is thereby reduced.

In the second planar transformer of the invention, in the first patterned conductor and the second patterned conductor, letting $r_i(n)$ be a radius of an inner circumference of a winding portion at the $n^{th}$ turn (n is an integer greater than or equal to 1 and less than or equal to N+1) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ may be determined so as to minimize the value of A expressed by equation (5) when the $r_{min}$, and D are given:

$$A = \sum_{n=1}^{N+1} K(n)\left(\log\frac{r_o(n)}{r_i(n)}\right)^{-1} \tag{5}$$

where K(1)=0.5; K(n)=2 when $n \geqq 2$; $r_i(1)=r_{min}$; $r_i(n+1)-r_o(n)=D$; and $r_o(N+1)-r_i(1)=W_{total}$.

In this way, by setting the $r_i(n)$ and $r_o(n)$ so as to minimize the value of A given by the equation (5), the resistance value of the entire winding becomes minimum, which results in a minimized loss in the entire winding.

Other objects, features and advantages of the invention will become sufficiently clear from the following description.

BEST MODE FOR CARRYING OUT THE INVENTION

Embodiments of the invention will now be described in detail with reference to the drawings.

[First Embodiment]

Figure 1:
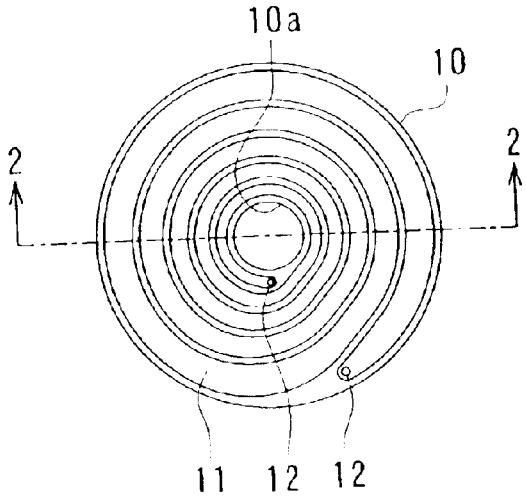
FIG. 1 is a top view of a planar coil according to a first embodiment of the invention.
Figure 2:
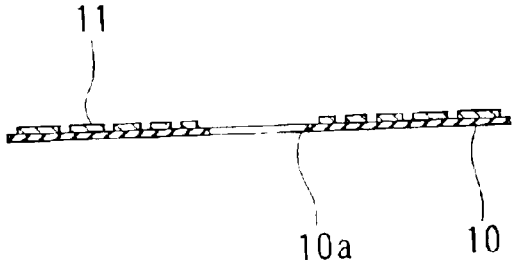
FIG. 2 is a cross-sectional view taken along line 2—2 of FIG. 1.

Reference is now made to FIG. 1 and FIG. 2 to describe a configuration of a planar coil according to a first embodiment of the invention. FIG. 1 is a top view of the planar coil according to the present embodiment. FIG. 2 is a cross-sectional view taken along line 2—2 of FIG. 1. The planar coil according to the embodiment comprises a disc-shaped insulating layer 10, and a winding 11 of N turns (N is an integer greater than or equal to two) formed on one of surfaces of the insulating layer 10. As an example, FIG. 1 shows the winding 11 of five turns. There is formed a circular hole 10*a* at the center portion of the insulating layer 10. The winding 11 is disposed in an area between the perimeter of the hole 10*a* and the perimeter of the insulating layer 10. The hole 10*a* is configured such that a core can be inserted therein.

The winding 11 is made of a patterned conductor that is formed by arranging a plate-like conductor, including a foil-like conductor, into a flat-spiral shape. The conductor may be copper, for example. Through-holes 12 that penetrate the winding 11 and the insulating layer 10 are formed at positions of both ends of the winding 11. For example, the through-holes 12 are used as terminals of the planar coil or as connecting portions for connecting a plurality of planar coils in parallel or in series to each other.

For example, the planar coil according to the embodiment may be fabricated by etching a conductor layer formed on one surface of an insulating substrate of a printed circuit board, or by stamping a conductor plate. Alternatively, the planar coil may also be fabricated by forming a patterned conductor on one surface of the insulating substrate using a thin-film forming technique such as a sputtering method.

In the planar coil according to the embodiment, the winding 11 includes winding portions of N turns. Letting $r_i(n)$ be the radius of the inner circumference (hereinafter referred to as inner radius) of a winding portion at the $n^{th}$ turn (n is an integer greater than or equal to one and less than or equal to N) from the inner side; $r_o(n)$ be the radius of the outer circumference (hereinafter referred to as outer radius) of the same; $r_{min}$ be the inner radius of the innermost winding portion; $W_{total}$ be a difference between the outer radius of the outermost winding portion and the inner radius of the innermost winding portion; and D be a distance between winding portions at adjacent turns, the $r_i(n)$ and $r_o(n)$ are determined so as to minimize the value of A given by the following equation (1) when the $r_{min}$, $W_{total}$ and D are given:

$$A = \sum_{n=1}^{N} \left(\log \frac{r_o(n)}{r_i(n)}\right)^{-1} \tag{1}$$

where $r_i(1)=r_{min}$, $r_i(n+1)-r_o(n)=D$, and $r_o(N)-r_i(1)=W_{total}$. Additionally, logx is a natural logarithm of x.

By setting the $r_i(n)$ and $r_o(n)$ so as to minimize the value of A given by the equation (1), the resistance value of the entire winding 11 becomes minimum, which results in a minimized loss in the entire winding 11. This will be discussed in more detail below.

First, let us consider a ring-shaped patterned conductor of thickness t, inner radius r, and outer radius r+dr. The resistance value of this patterned conductor may be represented by $(2\pi r\times\rho)/(t\times dr)$ if the width dr is sufficiently infinitesimal. Here, ρ is the volume resistivity of the conductor. Therefore, the conductance of the patterned conductor, i.e., the reciprocal of the resistance value, is $(t\times dr)/(2\pi r\times\rho)$.

The ring-shaped patterned conductor with inner radius $r_i$ and outer radius $r_o$ is considered to be equivalent to a plurality of ring-shaped patterned conductors connected in parallel to each other, each of the conductors having an infinitesimal width dr as mentioned above. Therefore, the conductance of the ring-shaped patterned conductor of thickness t, inner radius $r_i$, and outer radius $r_o$ can be determined by integrating the $(t\times dr)/(2\pi r\times\rho)$ over the range from $r_i$ to $r_o$ as shown in the following equation (2).

$$\int_{r_i}^{r_o}\frac{t}{2\pi r\rho}dr=\frac{t}{2\pi\rho}\int_{r_i}^{r_o}\frac{1}{r}dr=\frac{t}{2\pi\rho}\left[\log r\right]_{r_i}^{r_o}=\frac{t}{2\pi\rho}(\log r_o-\log r_i)=\frac{t}{2\pi\rho}\log\left(\frac{r_o}{r_i}\right) \tag{2}$$

The resistance value R of the ring-shaped patterned conductor of thickness t, inner radius $r_i$, and outer radius $r_o$ is the reciprocal of the conductance of this patterned conductor, and therefore is expressed by the following equation (3):

$$R=\frac{2\pi\rho}{t\cdot\log\frac{r_o}{r_i}} \tag{3}$$

The winding 11 made up of winding portions of N turns is considered to be equivalent to the N number of ring-shaped patterned conductors (winding portions) connected in series to each other. Therefore, the resistance value $R_{total}$ of the entire winding 11 of N turns is expressed by the following equation (4):

$$R_{total}=\sum_{n=1}^{N}\frac{2\pi\rho}{t\log\frac{r_o(n)}{r_i(n)}} \tag{4}$$

Therefore, setting the $r_i(n)$ and $r_o(n)$ so as to minimize the value of A expressed by the aforementioned equation (1) can minimize the resistance value of the entire winding 11 when the inner radius $r_{min}$ of the innermost winding portion, a difference $W_{total}$ between the outer radius of the outermost winding portion and the inner radius of the innermost winding portion, and a distance D between winding portions at adjacent turns are given.

Values of the $r_i(n)$ and $r_o(n)$ to minimize the value of A are difficult to find analytically, but can be determined through numerical calculation using a computer.

Now, explained below are working examples of the planar coil according to the present embodiment and the results of comparison of calculated resistance values between planar coils of the working examples and comparative examples.

A planar coil of a first working example includes, as shown in FIG. 1 and FIG. 2, the winding 11 of five turns. For this planar coil, copper was used as the conductor constituting the winding 11, thickness t of the conductor was set to 0.5 mm, inner radius $r_{min}$ of the innermost winding portion was set to 4 mm, difference $W_{total}$ between the outer radius of the outermost winding portion and the inner radius of the innermost winding portion was set to 12 mm, and distance D between winding portions at adjacent turns was set to 0.7 mm. For this planar coil, values of the inner radius $r_i(n)$ and the outer radius $r_o(n)$ for a winding portion at each turn to minimize the value of A expressed by the aforementioned equation (1), as well as a resistance value $R_{total}$ of the entire winding 11, were determined through numerical calculation using a computer. The volume resistivity of the copper was set to $1.72\times10^{-8}$ (Ωm). The width $r_o(n)-r_i(n)$ of a winding portion at each turn is hereinafter expressed as W(n).

Figure 3:
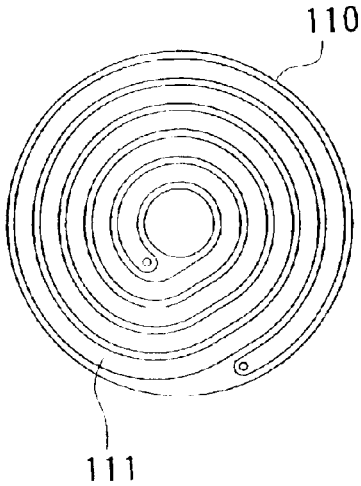
FIG. 3 is a top view of a planar coil of a first comparative example.

FIG. 3 is a top view of a planar coil of a first comparative example. The planar coil of the first comparative example comprises a disk-shaped insulating layer 110 and a winding 111 of five turns formed on one of surfaces of the insulating layer 110. This planar coil is constant in width W(n) of a winding portion at every turn. The other conditions of the planar coil of the first comparative example are the same as those of the planar coil of the first working example.

Figure 4:
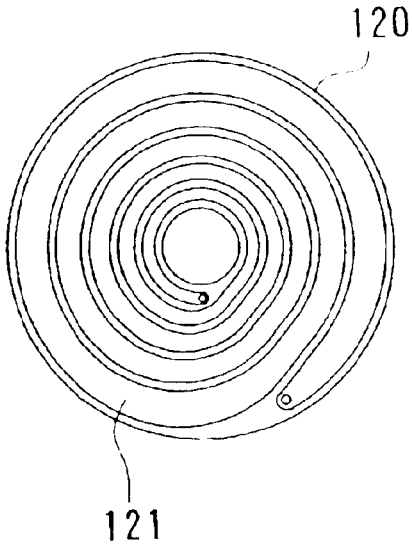
FIG. 4 is a top view of a planar coil of a second comparative example.

FIG. 4 is a top view of a planar coil of a second comparative example. The planar coil of the second comparative example comprises a disk-shaped insulating layer 120 and a winding 121 of five turns formed on one of surfaces of the insulating layer 120. This planar coil is constant in the ratio of the inner radius $r_i(n)$ to the width W(n), i.e., $r_i(n)/W(n)$, of a winding portion at each turn. The other conditions of the planar coil of the second comparative example are the same as those of the planar coil of the first working example.

For each of the planar coils of the first working example, the first comparative example and the second comparative example, the width W(n) of a winding portion at each turn and the resistance value $R_{total}$ of the entire winding are as shown in the following table.

| | First working example | First comparative example | Second comparative example |
|---|---|---|---|
| W(1) (mm) | 1.03 | 1.84 | 0.91 |
| W(2) (mm) | 1.37 | 1.84 | 1.28 |
| W(3) (mm) | 1.77 | 1.84 | 1.74 |
| W(4) (mm) | 2.24 | 1.84 | 2.29 |
| W(5) (mm) | 2.80 | 1.84 | 2.98 |
| $R_{total}$ (mΩ) | 5.232 | 5.854 | 5.252 |

As can be seen from the table above, according to the planar coil of the first working example, the resistance value $R_{total}$ of the entire winding is reduced by 10.63% compared with the planar coil of the first comparative example, and by 0.38% compared with the planar coil of the second comparative example.

Although not shown, a planar coil according to a second working example includes the winding 11 of four turns. For this planar coil, copper was used as the conductor constituting the winding 11, thickness t of the conductor was set to 0.06 mm, inner radius $r_{min}$ of the innermost winding portion was set to 3 mm, difference $W_{total}$ between the outer radius of the outermost winding portion and the inner radius of the innermost winding portion was set to 5 mm, and distance D between winding portions at adjacent turns was set to 0.2 mm. For this planar coil, values of the inner radius $r_i(n)$ and the outer radius $r_o(n)$ of a winding portion at each turn to minimize the value of A expressed by the aforementioned equation (1), as well as the resistance value $R_{total}$ of the entire winding 11, were determined through numerical calculation using a computer.

A planar coil of a third comparative example includes a winding of four turns, and is constant in width W(n) of a winding portion at every turn. The other conditions of the planar coil of the third comparative example are the same as those of the planar coil of the second working example.

A planar coil of a fourth comparative example includes a winding of four turns, and is constant in the ratio of the inner radius $r_i(n)$ to the width W(n), i.e., $r_i(n)/W(n)$, of a winding portion at each turn. The other conditions of the planar coil of the fourth comparative example are the same as those of the planar coil of the second working example.

For each of the planar coils of the second working example, the third comparative example and the fourth comparative example, the width W(n) of a winding portion at each turn and the resistance value $R_{total}$ of the entire winding are as shown in the following table.

| | Second working example | Third comparative example | Fourth comparative example |
|---|---|---|---|
| W(1) (mm) | 0.74 | 1.10 | 0.72 |
| W(2) (mm) | 0.95 | 1.10 | 0.94 |
| W(3) (mm) | 1.20 | 1.10 | 1.21 |
| W(4) (mm) | 1.51 | 1.10 | 1.54 |
| $R_{total}$ (mΩ) | 33.63 | 35.89 | 33.65 |

As can be seen from the table above, the planar coil of the second working example has a resistance value $R_{total}$ of the entire winding reduced by 6.31% compared with the planar coil of the third comparative example, and by 0.05%, although slight, compared with the planar coil of the fourth comparative example.

As described above, in the planar coil according to the present embodiment, since the $r_i(n)$ and $r_o(n)$ are set so as to minimize the value of A expressed by the equation (1), it is possible to minimize the resistance value of the entire winding 11. Thus, according to the embodiment, it is possible to arrange the winding 11 so as to minimize loss in a limited space, and to thereby reduce a loss caused by the resistance of the conductor. Furthermore, the planar coil according to the embodiment can attain reduction in a resistance value of the entire winding 11 as compared with a planar coil which is constant in width W(n) of a winding portion at every turn or with a planar coil which is constant in the ratio of the inner radius $r_i(n)$ to the width W(n), i.e., $r_i(n)/W(n)$, of a winding portion at each turn.

[Second Embodiment]

Figure 5:
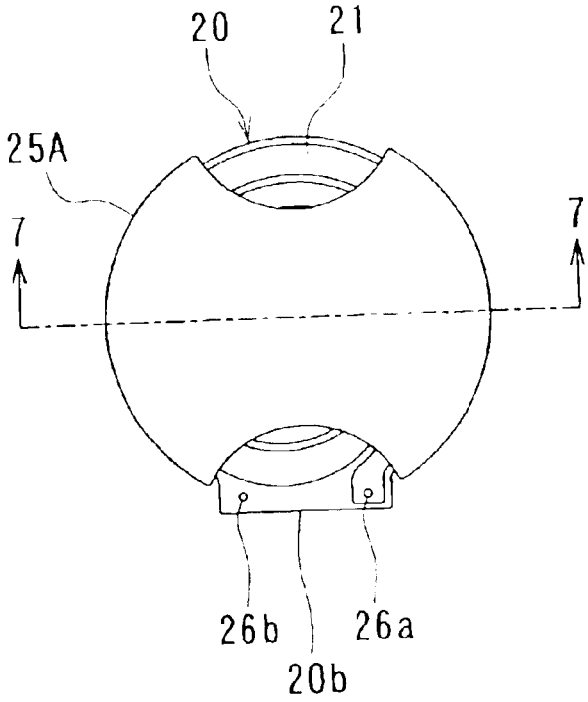
FIG. 5 is a top view of a planar coil according to a second embodiment of the invention.
Figure 6:
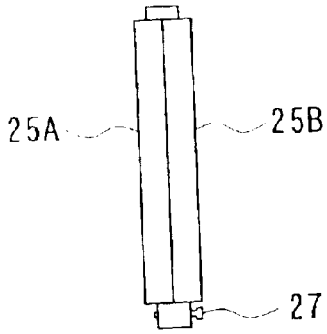
FIG. 6 is a right-hand side view of the planar coil shown in FIG. 5.
Figure 7:
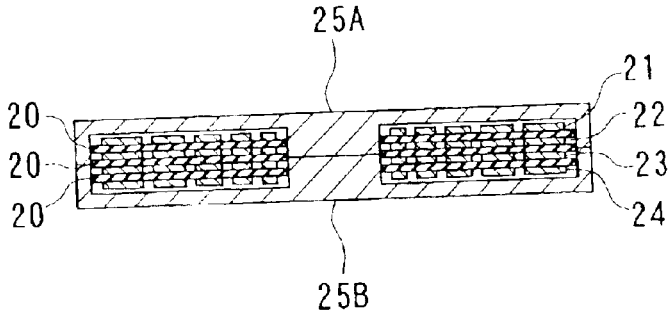
FIG. 7 is a cross-sectional view taken along line 7—7 of FIG. 5.

Now, description will be given of a configuration of a planar coil according to a second embodiment of the invention. FIG. 5 is a top view of the planar coil according to the embodiment; FIG. 6 is a right-hand side view of the planar coil shown in FIG. 5; and FIG. 7 is a cross-sectional view taken along line 7—7 of FIG. 5. As shown in these figures, the planar coil according to the embodiment comprises: four windings 21 to 24, stacked in the direction of thickness, each made of a patterned conductor formed of a plate-shaped conductor including a foil-shaped conductor; three insulating layers 20 each interposed between adjacent ones of the windings, and E-type cores 25A and 25B attached to a stacked body composed of the windings 21 to 24 and the insulating layers 20. For example, copper is employed as the conductor.

Figure 8:
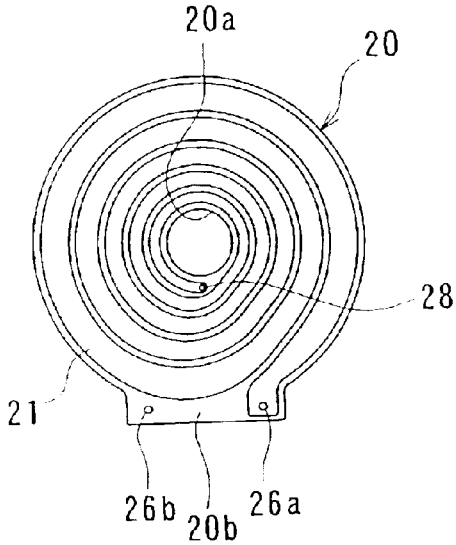
FIG. 8 is a top view showing the uppermost winding and an insulating layer below the same of the planar coil according to the second embodiment of the invention.
Figure 9:
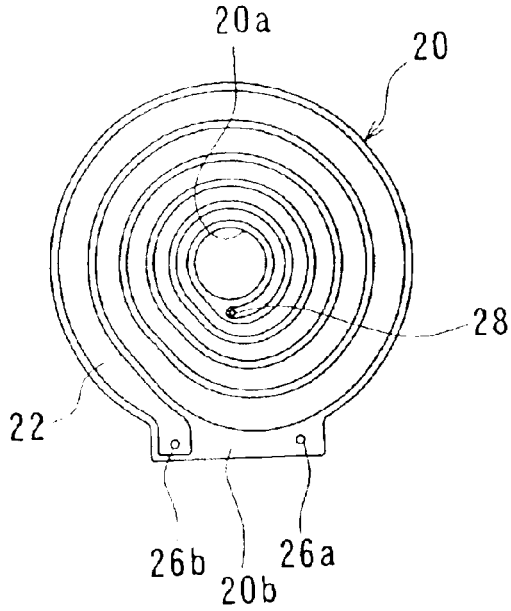
FIG. 9 is a top view showing the second uppermost winding and an insulating layer below the same of the planar coil according to the second embodiment of the invention.
Figure 10:
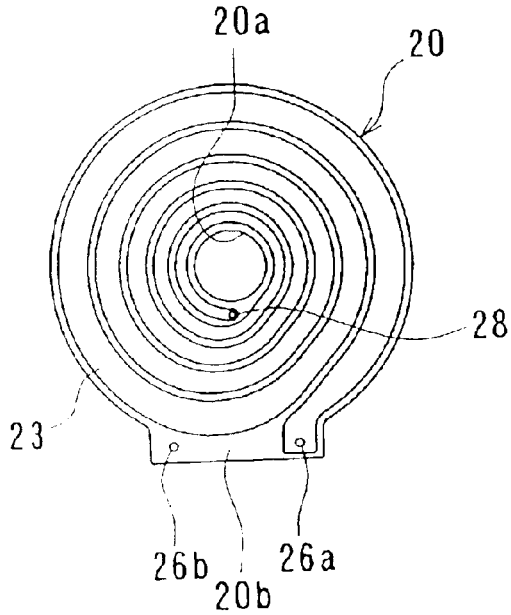
FIG. 10 is a top view showing the third uppermost winding and an insulating layer below the same of the planar coil according to the second embodiment of the invention.
Figure 11:
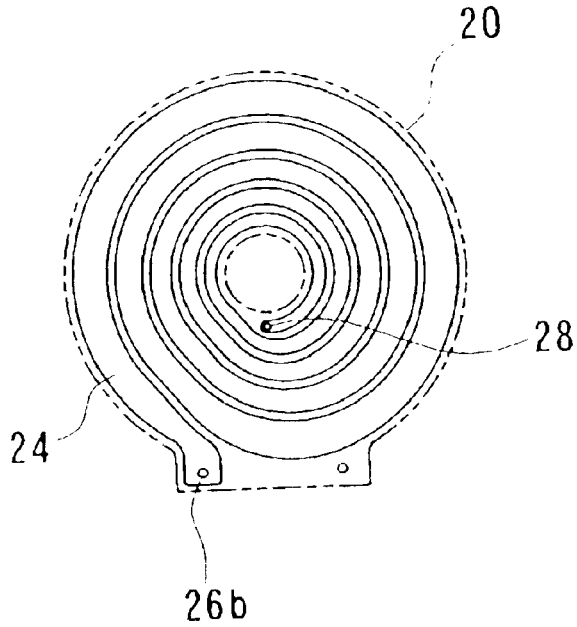
FIG. 11 is a top view showing the lowermost winding of the planar coil according to the second embodiment of the invention.

FIG. 8 is a top view showing the uppermost winding 21 and the insulating layer 20 below the same; FIG. 9 is a top view showing the second uppermost winding 22 and the insulating layer 20 below the same; FIG. 10 is a top view showing the third uppermost winding 23 and the insulating layer 20 below the same; FIG. 11 is a top view showing the lowermost winding 24; and FIG. 12 is a top view showing the insulating layer 20.

Figure 12:
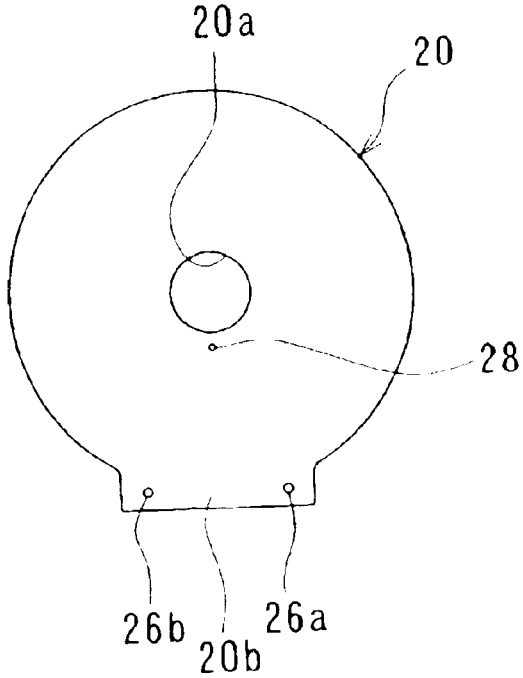
FIG. 12 is a top view showing the insulating layer of the planar coil according to the second embodiment of the invention.

As shown in FIG. 12, each insulating layer 20 is generally disk-shaped. There is formed a circular hole 20*a* at the central portion of each insulating layer 20. Each insulating layer 20 has also an extended portion 20*b*, i.e., a portion of the perimeter thereof expanded outward in a direction of the radius. The windings 21 to 24 are each disposed in an area between the perimeter of the hole 20*a* and the perimeter of the respective insulating layers 20.

Each of the windings 21 to 24 is made of a patterned conductor that is formed by arranging a plate-like conductor, including a foil-like conductor, into a flat-spiral shape. Additionally, each of the windings 21 to 24 is a winding of N turns (N is an integer greater than or equal to two). By way of example, FIG. 8 to FIG. 11 illustrate the windings 21 to 24 of five turns, respectively.

As shown in FIG. 8 and FIG. 10, the windings 21 and 23 are wound in a clockwise direction from inner to outer side. The outer ends of the windings 21 and 23 are located on the right-hand side in the extended portion 20*b* of the insulating layer 20. At the position at which the outer ends of the windings 21 and 23 are located, there is formed a through-hole 26*a* that penetrates the three insulating layers 20 and the windings 21 and 23. The outer ends of the windings 21 and 23 are electrically connected to each other via the through-hole 26*a*.

As shown in FIG. 9 and FIG. 11, the windings 22 and 24 are wound in a counterclockwise direction from inner to outer side. The outer ends of the windings 22 and 24 are located on the left-hand side in the extended portion 20*b* of the insulating layer 20. At the position at which the outer ends of the windings 22 and 24 are located, there is formed a through-hole 26*b* that penetrates the three insulating layers 20 and the windings 22 and 24. The outer ends of the windings 22 and 24 are electrically connected to each other via the through-hole 26*b*.

As shown in FIG. 8 to FIG. 11, the inner ends of the windings 21 to 24 are disposed at positions that coincide with each other. At the position where the inner ends of the windings 21 to 24 are located, there is formed a through-hole 28 that penetrates the three insulating layers 20 and the windings 21 to 24. The inner ends of the windings 21 to 24 are electrically connected to each other via the through-hole 28.

In such a manner, the windings 21 and 23 are connected in parallel to each other, and the windings 22 and 24 are also connected in parallel to each other. The windings 21/23 are connected in series to the windings 22/24. Accordingly, when each of the windings 21 to 24 has five turns, the windings 21 to 24 form a winding of 10 turns.

For example, as shown in FIG. 6, each of the through-holes 26*a* and 26*b* is configured such that a terminal 27 is inserted therein.

Additionally, as shown in FIG. 7, the E-type cores 25A and 25B are disposed to allow their central projections to butt against each other through the hole 20*a* of the insulating layer 20.

The windings 21 and 22 may be formed by etching conductor layers formed on both surfaces of an insulating substrate of a double-sided printed circuit board. The windings 23 and 24 may be formed in the same manner. In this case, the stacked body composed of the windings 21 to 24 and the insulating layers 20 may be fabricated by stacking the two double-sided printed circuit boards via the insulating layer 20. Alternatively, the stacked body composed of the windings 21 to 24 and the insulating layers 20 may be fabricated by: forming the windings 22 and 23 by etching conductor layers on a double-sided printed circuit board, then stacking single-sided printed circuit boards on top and bottom of the double-sided printed circuit board via insulating layers, and then etching conductor layers of the two exposed single-sided printed circuit boards to thereby form the windings 21 and 24. Alternatively, the stacked body composed of the windings 21 to 24 and the insulating layers 20 may be fabricated by stamping a conductor plate to form the windings 21 to 24, and then by stacking the windings via insulating layers made of a material such as polyimide film. Alternatively, the stacked body composed of the windings 21 to 24 and the insulating layers 20 may be fabricated by using a thin-film forming technique such as a sputtering method.

In the planar coil according to the present embodiment, each of the windings 21 to 24 includes winding portions of N turns, like the winding 11 of the first embodiment. Letting $r_i(n)$ be the inner radius of a winding portion at the $n^{th}$ turn from the inner side; $r_o(n)$ be the outer radius of the same; $r_{min}$ be the inner radius of the innermost winding portion; $W_{total}$ be a difference between the outer radius of the outermost winding portion and the inner radius of the innermost winding portion; and D be a distance between winding portions at adjacent turns, the $r_i(n)$ and $r_o(n)$ are determined so as to minimize the value of A given by the equation (1) when the $r_{min}$, $W_{total}$ and D are given.

The remainder of the configuration, functions and effects of the present embodiment are the same as those of the first embodiment.

[Third Embodiment]

Figure 13:
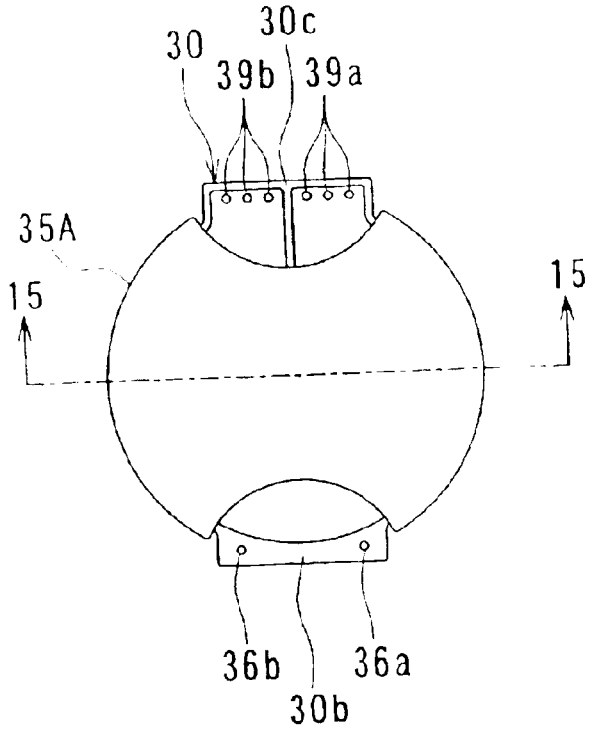
FIG. 13 is a top view of a planar transformer according to a third embodiment of the invention.
Figure 14:
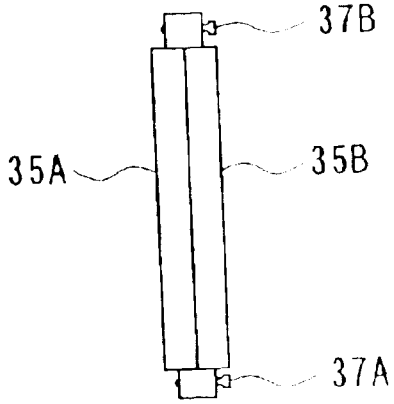
FIG. 14 is a right-hand side view of the planar transformer shown in FIG. 13.
Figure 15:
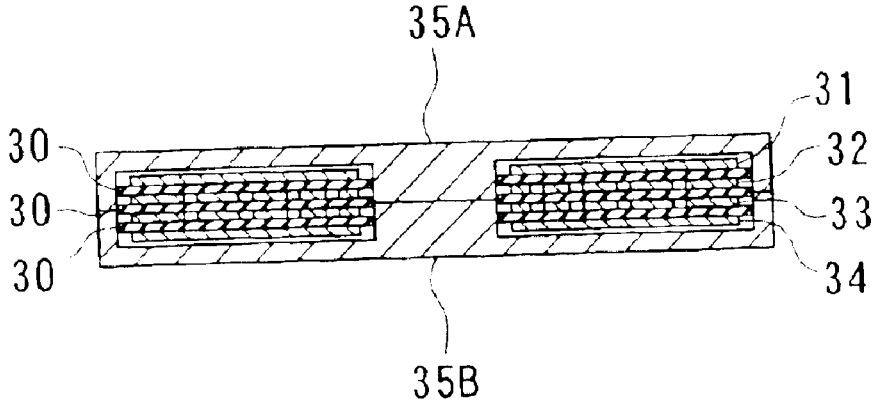
FIG. 15 is a cross-sectional view taken along line 15—15 of FIG. 13.

Now, description will be given of a configuration of a planar transformer according to a third embodiment of the invention. FIG. 13 is a top view of the planar transformer according to the embodiment; FIG. 14 is a right-hand side view of the planar transformer shown in FIG. 13; and FIG. 15 is a cross-sectional view taken along line 15—15 of FIG. 13. As shown in these figures, the planar transformer according to the embodiment comprises: four windings 31 to 34, stacked in a direction of thickness, each made of a patterned conductor formed of a plate-shaped conductor including a foil-shaped conductor; three insulating layers 30 each interposed between adjacent ones of the windings, and E-type cores 35A and 35B attached to a stacked body composed of the windings 31 to 34 and the insulating layers 30. For example, copper is employed as the conductor. The windings 31 to 34 correspond to "a plurality of windings each formed into a flat shape and stacked in a direction of thickness" of the invention.

Figure 16:
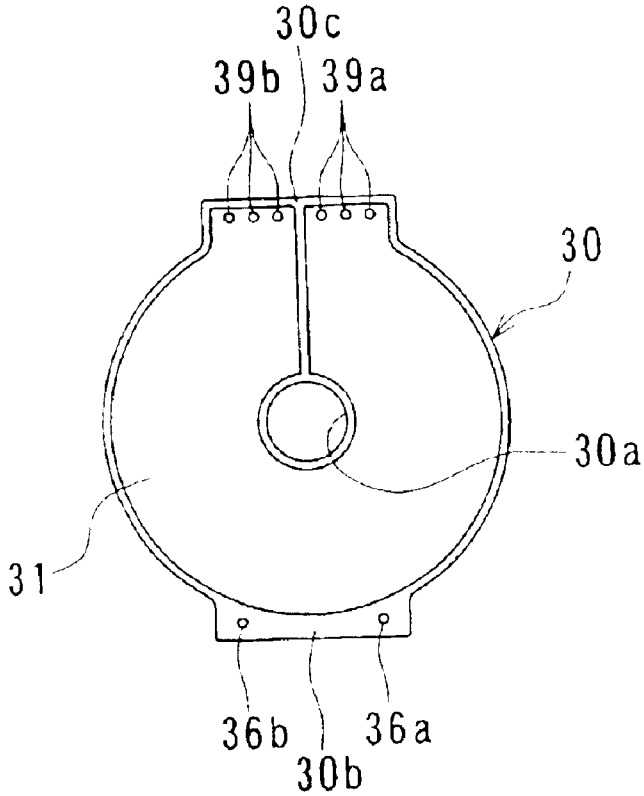
FIG. 16 is a top view showing the uppermost winding and an insulating layer below the same of the planar transformer according to the third embodiment of the invention.
Figure 17:
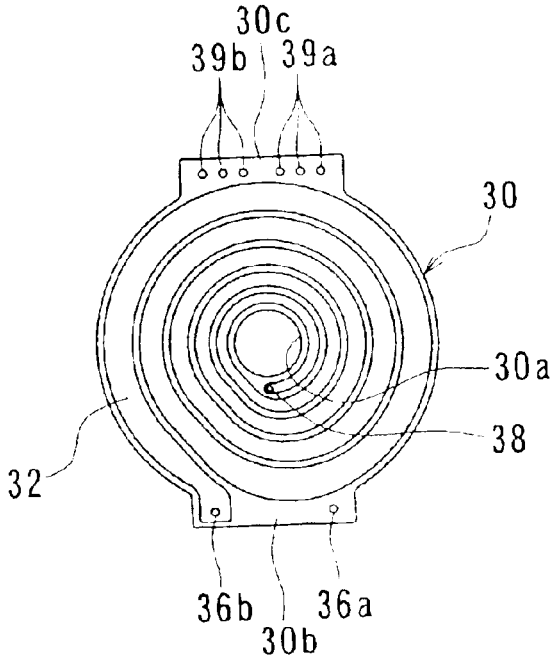
FIG. 17 is a top view showing the second uppermost winding and an insulating layer below the same of the planar transformer according to the third embodiment of the invention.
Figure 18:
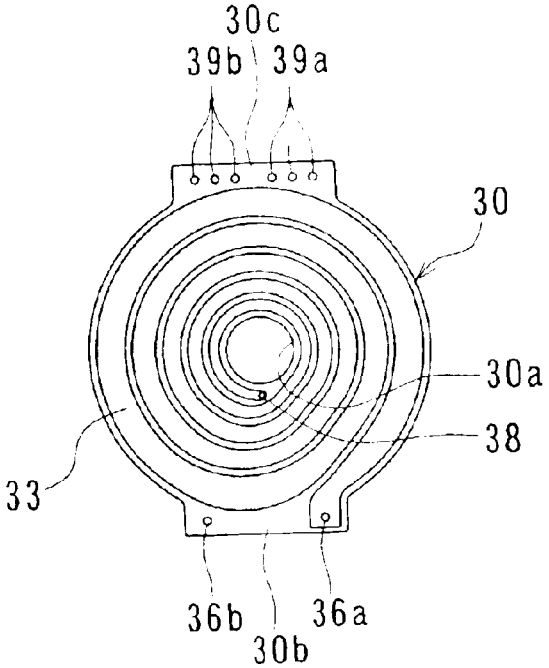
FIG. 18 is a top view showing the third uppermost winding and an insulating layer below the same of the planar transformer according to the third embodiment of the invention.
Figure 19:
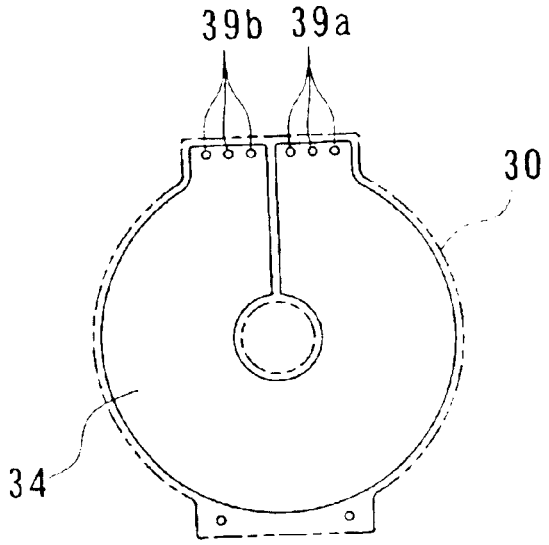
FIG. 19 is a top view showing the lowermost winding of the planar transformer according to the third embodiment of the invention.

FIG. 16 is a top view showing the uppermost winding 31 and the insulating layer 30 below the same; FIG. 17 is a top view showing the second uppermost winding 32 and the insulating layer 30 below the same; FIG. 18 is a top view showing the third uppermost winding 33 and the insulating layer 30 below the same; FIG. 19 is a top view showing the lowermost winding 34; and FIG. 20 is a top view showing the insulating layer 30.

Figure 20:
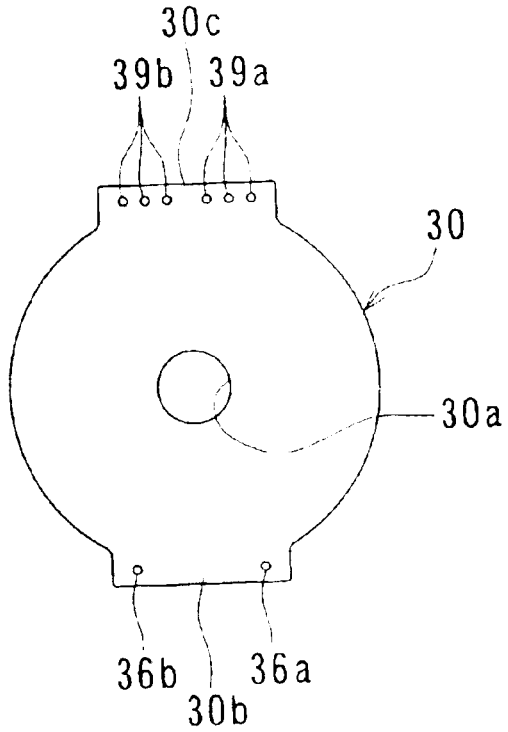
FIG. 20 is a top view showing the insulating layer of the planar transformer according to the third embodiment of the invention.

As shown in FIG. 20, each insulating layer 30 is generally disk-shaped. There is formed a circular hole 30*a* at the central portion of each insulating layer 30. Each insulating layer 30 has also extended portions 30*b* and 30*c*, i.e., portions of the perimeter thereof expanded outward in a direction of the radius. The expanded portions 30*b* and 30*c* are located at diametrically opposed positions relative to the hole 30*a*. The windings 31 to 34 are each disposed in an area between the perimeter of the hole 30*a* and the perimeter of the respective insulating layers 30. Although not shown in FIG. 20, in the insulating layer 30 disposed between the windings 32 and 33, there is formed a through-hole 28 to be described later.

As shown in FIG. 16 and FIG. 19, each of the windings 31 and 34 is a winding of one turn. One end of each of the windings 31 and 34 is located on the right-hand position in the extended portion 30*c* of the insulating layer 30. At the position at which the one end of each of the windings 31 and 34 is located, there is formed a through-hole 39*a* that penetrates the three insulating layers 30 and the windings 31 and 34. The one ends of the windings 31 and 34 are electrically connected to each other via the through-hole 39*a*. The other end of each of the windings 31 and 34 is located on the left-hand position in the extended portion 30*c* of the insulating layer 30. At the position at which the other end of each of the windings 31 and 34 is located, there is formed a through-hole 39*b* that penetrates the three insulating layers 30 and the windings 31 and 34. The other ends of the windings 31 and 34 are electrically connected to each other via the through-hole 39*b*. Accordingly, the windings 31 and 34 are connected in parallel to each other.

On the other hand, as shown in FIG. 17 and FIG. 18, each of the windings 32 and 33 is made of a patterned conductor that is formed by arranging a plate-like conductor, including a foil-like conductor, into a flat-spiral shape. Additionally, each of the windings 32 and 33 is a winding of N turns (N is an integer greater than or equal to two). By way of example, FIG. 17 and FIG. 18 illustrate the windings 32 and 33 of five turns, respectively.

As shown in FIG. 17, the winding 32 is wound in a counterclockwise direction from inner to outer side. The outer end of the winding 32 is located on the left-hand side in the extended portion 30*b* of the insulating layer 30. At the position at which the outer end of the winding 32 is located, there is formed a through-hole 36*b* that penetrates the three insulating layers 30 and the winding 32.

As shown in FIG. 18, the winding 33 is wound in a clockwise direction from inner to outer side. The outer end of the winding 33 is located on the right-hand side in the extended portion 30*b* of the insulating layer 30. At the position at which the outer end of the winding 33 is located, there is formed a through-hole 36*a* that penetrates the three insulating layers 30 and the winding 33.

As shown in FIG. 17 and FIG. 18, the inner ends of the windings 32 and 33 are disposed at positions that coincide with each other. At the position where the inner ends of the windings 32 and 33 are located, there is formed the through-hole 38 that penetrates the windings 32 and 33 and the insulating layer 30 disposed therebetween. The inner ends of the windings 32 and 33 are electrically connected to each other via the through-hole 38. Accordingly, the windings 32 and 33 are connected in series to each other. When each of the windings 32 and 33 has five turns, the windings 32 and 33 form a winding of 10 turns.

For example, as shown in FIG. 14, each of the through-holes 36*a* and 36*b* is configured such that a terminal 37A is inserted therein, and the through-hole 39 is configured such that a terminal 37B is inserted therein.

Additionally, as shown in FIG. 15, the E-type cores 35A and 35B are disposed to allow their central projections to butt against each other through the hole 30*a* of the insulating layer 30.

The windings 31 and 32 may be formed by etching conductor layers formed on both surfaces of an insulating substrate of a double-sided printed circuit board. The windings 33 and 34 may be formed in the same manner. In this case, the stacked body composed of the windings 31 to 34 and the insulating layers 30 may be fabricated by stacking the two double-sided printed circuit boards via the insulating layer 30. Alternatively, the stacked body composed of the windings 31 to 34 and the insulating layers 30 may be fabricated by: forming the windings 32 and 33 by etching conductor layers on a double-sided printed circuit board, then stacking single-sided printed circuit boards on top and bottom of the double-sided printed circuit board via insulating layers, and then etching conductor layers of the two exposed single-sided printed circuit boards to thereby form the windings 31 and 34. Alternatively, the stacked body composed of the windings 31 to 34 and the insulating layers 30 may be fabricated by stamping a conductor plate to form the windings 31 to 34, and then by stacking the windings via insulating layers made of a material such as polyimide film. Alternatively, the stacked body composed of the windings 31 to 34 and the insulating layers 30 may be fabricated by using a thin-film forming technique such as a sputtering method.

In the planar transformer according to the embodiment, one of the windings 31/34 and 32/33 serves as a primary winding and the other as a secondary winding.

In the planar transformer according to the embodiment, each of the windings 32 and 33 includes winding portions of N turns, like the winding 11 of the first embodiment. Letting $r_i(n)$ be the inner radius of a winding portion at the $n^{th}$ turn from the inner side; $r_o(n)$ be the outer radius of the same; $r_{min}$ be the inner radius of the innermost winding portion; $W_{total}$ be a difference between the outer radius of the outermost winding portion and the inner radius of the innermost winding portion; and D be a distance between winding portions at adjacent turns, the $r_i(n)$ and $r_o(n)$ are determined so as to minimize the value of A given by the equation (1) when the $r_{min}$, $W_{total}$ and D are given.

The remainder of the configuration, functions and effects of the present embodiment are the same as those of the first embodiment.

In the first to third embodiments, the number of turns and the number of windings can be set to any number.

Additionally, in the first to third embodiments, the winding may be formed of a conductor other than plate-shaped ones, and may be formed of a rounded wire conductor, for example.

As described in the foregoing, in the first to third embodiments, by setting the $r_i(n)$ and $r_o(n)$ so as to minimize the value of A expressed by the equation (1), it is possible to arrange the winding so as to minimize loss in a limited space, and to thereby reduce a loss caused by the resistance of the conductor.

[Fourth Embodiment]

Figure 21:
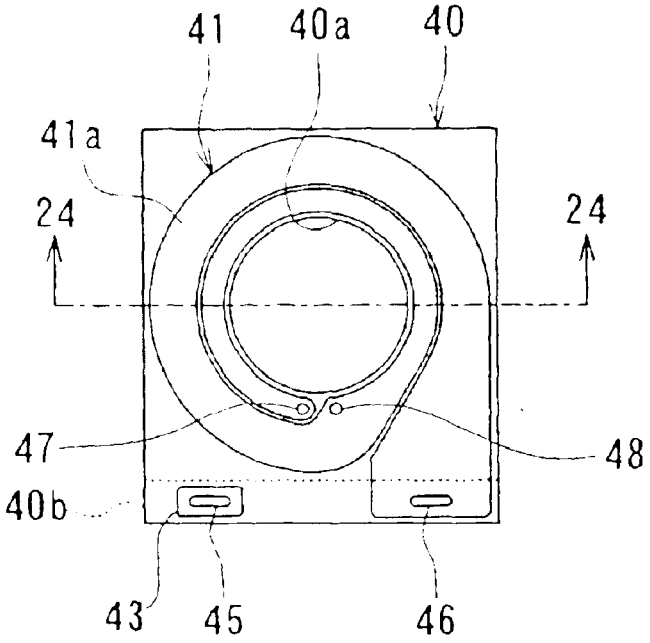
FIG. 21 is a top view showing a first conductor layer and an insulating layer below the same of a planar coil according to a fourth embodiment of the invention.
Figure 22:
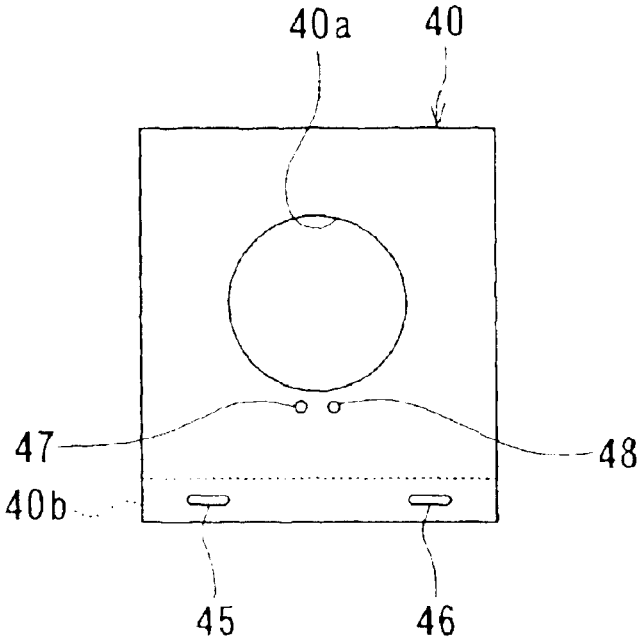
FIG. 22 is a top view showing the insulating layer of the planar coil according to the fourth embodiment of the invention.
Figure 23:
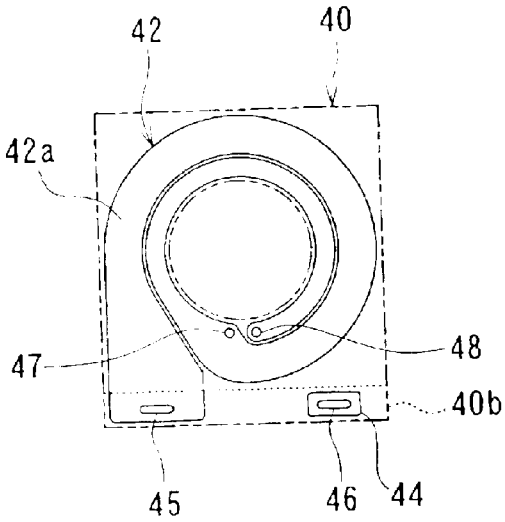
FIG. 23 is a top view showing a second conductor layer of the planar coil according to the fourth embodiment of the invention.
Figure 24:
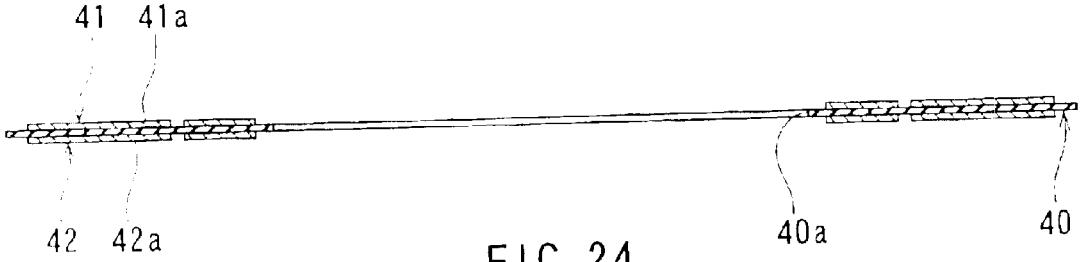
FIG. 24 is an enlarged cross-sectional view taken along line 24—24 of FIG. 21.

Reference is now made to FIG. 21 to FIG. 24 to describe a configuration of a planar coil according to a fourth embodiment of the invention. FIG. 21 is a top view showing a first conductor layer and an insulating layer below the same of the planar coil according to the embodiment; FIG. 22 is a top view showing the insulating layer of the planar coil according to the embodiment; FIG. 23 is a top view showing a second conductor layer of the planar coil according to the embodiment; and FIG. 24 is an enlarged cross-sectional view taken along line 24—24 of FIG. 21.

The planar coil according to the embodiment comprises: a rectangular plate-shaped insulating layer 40; a first conductor layer 41 formed on one surface (top surface) of the insulating layer 40; and a second conductor layer 42 formed on the other surface (bottom surface) of the insulating layer 40. Thus, the first conductor layer 41 and the second conductor layer 42 are adjacent to each other via the insulating layer 40.

In the vicinity of one of side portions of the insulating layer 40, there is provided a terminal area 40*b* in which terminals of the windings are disposed. There is formed a circular hole 40*a* at the center of part of the insulating layer 40 excluding the terminal area 40*b*. The hole 40*a* is configured such that a core can be inserted therein.

As shown in FIG. 21, the first conductor layer 41 includes a first patterned conductor 41*a* that is formed by arranging a plate-like conductor, including a foil-like conductor, into a flat-spiral shape. For example, copper is employed as the conductor. Likewise, as shown in FIG. 23, the second conductor layer 42 includes a second patterned conductor 42*a* that is formed by arranging a plate-like conductor, including a foil-like conductor, into a flat-spiral shape. Each of the first patterned conductor 41*a* and the second patterned conductor 42*a* is disposed in an area between the perimeter of the hole 40*a* and the perimeter of the insulating layer 40.

The planar coil according to the present embodiment may be fabricated by etching conductor layers formed on both surfaces of an insulating substrate of a double-sided printed circuit board, or by stamping a conductor plate. Alternatively, the planar coil may also be fabricated by using a thin-film forming technique such as a sputtering method.

The first patterned conductor 41*a* and the second patterned conductor 42*a* each include winding portions of N (N is an integer greater than or equal to one) plus one turns. The present embodiment is configured so that N=1. That is, the first patterned conductor 41*a* and the second patterned conductor 42*a* each include winding portions of two turns.

The first patterned conductor 41*a* and the second patterned conductor 42*a* are wound in opposite directions. That is, as shown in FIG. 21, the first patterned conductor 41*a* is wound in a clockwise direction from inner to outer side, whereas as shown in FIG. 23, the second patterned conductor 42*a* is wound in a counterclockwise direction from inner to outer side.

As shown in FIG. 21, the outer end of the first patterned conductor 41*a* is located at the right-hand position in the terminal area 40*b* of the insulating layer 40. On the one surface (top surface) of the insulating layer 40, a terminal layer 43 serving as a terminal is provided at the left-hand position in the terminal area 40*b*.

As shown in FIG. 23, the outer end of the second patterned conductor 42*a* is located at the left-hand position in the terminal area 40*b* of the insulating layer 40. On the other surface (bottom surface) of the insulating layer 40, a terminal layer 44 serving as a terminal is provided at the right-hand position in the terminal area 40*b*.

At the left-hand position in the terminal area 40*b*, there is formed a through-hole 45 that penetrates the terminal layer 43, the insulating layer 40, and the outer end of the second patterned conductor 42*a*. The terminal layer 43 and the outer end of the second patterned conductor 42*a* are electrically connected to each other via the through-hole 45.

At the right-hand position in the terminal area 40*b*, there is formed a through-hole 46 that penetrates the outer end of the first patterned conductor 41*a*, the insulating layer 40, and the terminal layer 44. The outer end of the first patterned conductor 41*a* and the terminal layer 44 are electrically connected to each other via the through-hole 46.

As shown in FIG. 21 and FIG. 23, the innermost winding portions of the first and second patterned conductors 41*a* and 42*a* are connected in parallel to each other via through-holes 47 and 48 that penetrate the patterned conductors 41*a* and 42*a* and the insulating layer 40. These winding portions form a conductive path corresponding to one turn of the winding. The through-holes 47 and 48 are provided at positions of the ends of the innermost winding portions of the patterned conductors 41*a* and 42*a*, respectively.

Additionally, the other winding portions of the first and second patterned conductors 41*a* and 42*a* form a conductive path corresponding to 2N=2 turns. Thus, the first patterned conductor 41*a* and the second patterned conductor 42*a* form a winding of 2N+1=3 turns.

In the present embodiment, as shown in FIG. 21 and FIG. 23, the first patterned conductor 41*a* and the second patterned conductor 42*a* may be formed into the same pattern in terms of width. Accordingly, the present embodiment makes it possible to avoid causing a significant difference in width between portions of the patterned conductors, except between the innermost winding portions and the other winding portions. In the embodiment, one of the conductive paths, i.e., the conductive path corresponding to one turn that is formed by the innermost winding portions of the first and second patterned conductors 41*a* and 42*a*, is twice as thick as the other conductive path. However, by adjusting the width thereof, it is possible to reduce the resistance value of the entire winding and to thereby reduce loss of the entire winding.

In the present embodiment, as shown in FIG. 21 and FIG. 23, the innermost winding portion of each of the first and second patterned conductors 41*a* and 42*a* is substantially half the width of the other winding portion. The other winding portion is constant in width. The conductive path corresponding to one turn that is formed by the innermost winding portions of the first and second patterned conductors 41*a* and 42*a* is twice as thick as the other conductive path. However, since the width of the conductive path is substantially half that of the other conductive path, the cross-sectional area of the same is substantially equal to that of the other conductive path. Thus, according to the planar coil of the embodiment, the current density is uniformalized for every portion of the three turns, and a loss in the winding is thereby reduced.

In addition, according to the embodiment, the two conductor layers 41 and 42 can form a winding of three turns. Furthermore, according to the embodiment, two terminals of the winding can be drawn out from the outer ends of the two patterned conductors 41*a* and 42*a*. Thus, both terminals of the winding can be disposed outside a wide core, which makes it possible to use a core small in thickness and having a wide connecting portion between the middle foot and the outer feet. From the foregoing, the embodiment can attain a planar coil of smaller thickness.

Furthermore, according to the embodiment, the number of layers of the conductor layers 41 and 42 can be designed in two-layer increments, which allows a higher degree of flexibility in designing the number of layers of the conductor layers 41 and 42.

[Fifth Embodiment]

Figure 25:
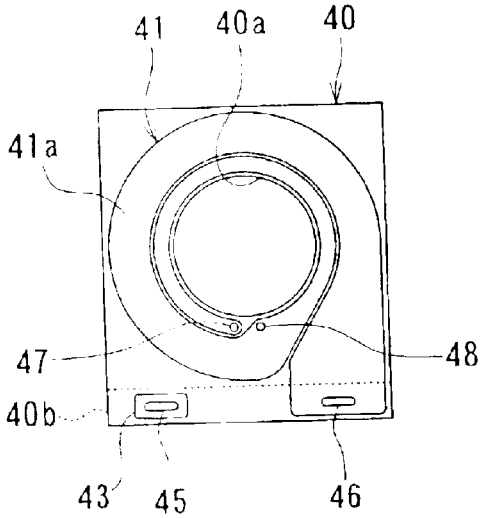
FIG. 25 is a top view showing a first conductor layer and an insulating layer below the same of a planar coil according to a fifth embodiment of the invention.
Figure 26:
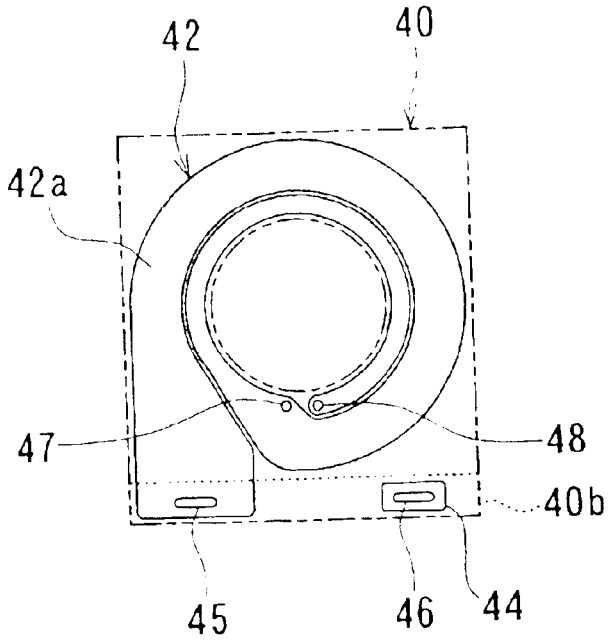
FIG. 26 is a top view showing a second conductor layer of the planar coil according to the fifth embodiment of the invention.

Reference is now made to FIG. 25 and FIG. 26 to describe a configuration of a planar coil according to a fifth embodiment of the invention. FIG. 25 is a top view showing a first conductor layer and an insulating layer below the same of the planar coil according to the embodiment. FIG. 26 is a top view showing a second conductor layer of the planar coil according to the embodiment.

The configuration of the planar coil according to the embodiment is the same as that of the planar coil according to the fourth embodiment except that the patterned conductors 41*a* and 42*a* are different in shape.

According to the planar coil of the embodiment, in the first patterned conductor 41*a* and the second patterned conductor 42*a*, letting $r_i(n)$ be the radius of the inner circumference of a winding portion at the $n^{th}$ turn (n is an integer greater than or equal to 1 and less than or equal to N+1) from the inner side; $r_o(n)$ be the radius of the outer circumference of the same; $r_{min}$ be the radius of the inner circumference of the innermost winding portion; $W_{total}$ be a difference between the radius of the outer circumference of the outermost winding portion and the radius of the inner circumference of the innermost winding portion; and D be a distance between winding portions at adjacent turns, the $r_i(n)$ and $r_o(n)$ are determined so as to minimize the value of A given by the following equation (5) when the $r_{min}$, $W_{totla}$ and D are given: 4

$$A = \sum_{n=1}^{N+1} K(n)\left(\log\frac{r_o(n)}{r_i(n)}\right)^{-1} \tag{5}$$

where K(1)=0.5; K(n)=2 when n≧2; $r_i(\mathbf{1})=r_{min}$; $r_i(n+1)-r_o(n)=D$; and $r_o(N+1)-r_i(\mathbf{1})=W_{total}$. Additionally, logx is a natural logarithm of x.

By setting the $r_i(n)$ and $r_o(n)$ so as to minimize the value of A given by the equation (5), the resistance value of the entire winding of 2N+1 turns becomes minimum, which results in a minimized loss in the entire winding. This will be discussed in more detail below.

First, let us consider a ring-shaped patterned conductor of thickness t, inner radius r, and outer radius r+dr. The resistance value of the patterned conductor may be represented by $(2\pi r\times\rho)/(t\times dr)$ if the width dr is sufficiently infinitesimal. Here, ρ is the volume resistivity of the conductor. Therefore, the conductance of the patterned conductor, i.e., the reciprocal of the resistance value, is $(t\times dr)/(2\pi r\times\rho)$.

The ring-shaped patterned conductor with inner radius $r_i$ and outer radius $r_o$ is considered to be equivalent to a plurality of ring-shaped patterned conductors connected in parallel to each other, each of the conductors having an infinitesimal width dr as mentioned above. Therefore, the conductance of the ring-shaped patterned conductor of thickness t, inner radius $r_i$, and outer radius $r_o$ can be determined by integrating the $(t\times dr)/(2\pi r\times\rho)$ over the range from $r_i$ to $r_o$ as shown in the following equation (6).

$$\begin{aligned}\int_{r_i}^{r_o}\frac{t}{2\pi r\rho}dr &= \frac{t}{2\pi\rho}\int_{r_i}^{r_o}\frac{1}{r}dr = \frac{t}{2\pi\rho}\left[\log r\right]_{r_i}^{r_o} \\ &= \frac{t}{2\pi\rho}(\log r_o - \log r_i) = \frac{t}{2\pi\rho}\log\left(\frac{r_o}{r_i}\right)\end{aligned} \tag{6}$$

The resistance value R of the ring-shaped patterned conductor of thickness t, inner radius $r_i$, and outer radius $r_o$ is the reciprocal of the conductance of the patterned conductor, and therefore is expressed by the following equation (7):

$$R = \frac{2\pi\rho}{t\cdot\log\left(\frac{r_o}{r_i}\right)} \tag{7}$$

Here, it is set that $2\pi\rho/t=B$. The resistance value R of the conductive path corresponding to one turn that is formed by the innermost winding portions of the first and second patterned conductors 41*a* and 42*a* is expressed by the following equation (8):

$$R = \frac{1}{2} \cdot \frac{B}{\log\frac{r_o(1)}{r_i(1)}} \tag{8}$$

On the other hand, the sum R of a resistance value per turn of another winding portion of the first patterned conductor 41*a* and a resistance value per turn of another winding portion of the second patterned conductor 42*a* is expressed by the following equation (9):

$$R = 2 \cdot \frac{B}{\log\frac{r_o(n)}{r_i(n)}} \tag{9}$$

Therefore, the resistance $R_{total}$ of the entire winding of 2N+1 turns is expressed by the following equation (10):

$$R_{total} = \frac{1}{2} \cdot \frac{B}{\log\frac{r_o(1)}{r_i(1)}} + \sum_{n=2}^{N+1} 2 \cdot \frac{B}{\log\frac{r_o(n)}{r_i(n)}} \tag{10}$$

Accordingly, in the first patterned conductor 41*a* and the second patterned conductor 42*a*, setting the $r_i(n)$ and $r_o(n)$ so as to minimize the value of A expressed by the aforementioned equation (5) can minimize the resistance value of the entire winding of 2N+1 turns when the inner radius $r_{min}$ of the innermost winding portion, a difference $W_{total}$ between the outer radius of the outermost winding portion and the inner radius of the innermost winding portion, and a distance D between winding portions at adjacent turns are given.

Values of the $r_i(n)$ and $r_o(n)$ to minimize the value of A are difficult to find analytically, but can be determined through numerical calculation using a computer.

The present embodiment is configured so that the first patterned conductor 41*a* and the second patterned conductor 42*a* form a winding of three turns, by setting N=1.

According to the planar coil of the present embodiment, it is possible to minimize the resistance value of the entire winding because the $r_i(n)$ and $r_o(n)$ are set so as to minimize the value of A expressed by the equation (5). The embodiment thus makes it possible to arrange the winding so as to minimize loss in a limited space, and to thereby reduce a loss caused by resistance of the conductor.

The remainder of the configuration, functions and effects of the present embodiment are the same as those of the fourth embodiment.

Now, explained below are an example of the planar coil according to the fourth embodiment (hereinafter referred to as a third working example) and an example of the planar coil according to the fifth embodiment (hereinafter referred to as a fourth working example), and the results of comparison of calculated resistance values between planar coils of the working examples and those of two comparative examples.

Figure 27:
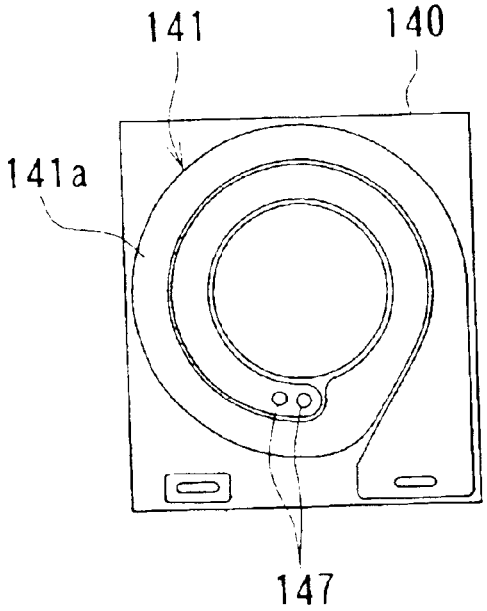
FIG. 27 is a top view showing a first conductor layer and an insulating layer below the same of a planar coil of a fifth comparative example.
Figure 28:
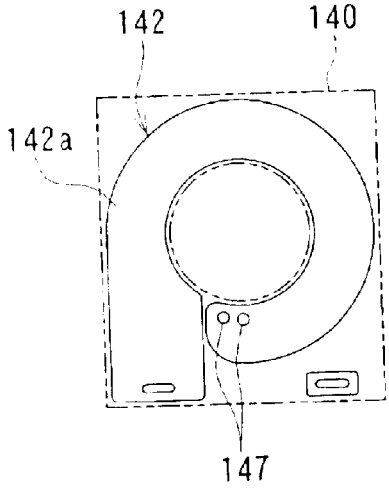
FIG. 28 is a top view showing a second conductor layer of the planar coil of the fifth comparative example.

FIG. 27 is a top view showing a first conductor layer and an insulating layer below the same of a planar coil of a fifth comparative example. FIG. 28 is a top view showing a second conductor layer of the planar coil of the fifth comparative example. The planar coil of the fifth comparative example comprises an insulating layer 140, and a first conductor layer 141 and a second conductor layer 142 formed on the surfaces of the insulating layer 140. The first conductor layer 141 includes a first patterned conductor 141*a,* while the second conductor layer 142 includes a second patterned conductor 142*a*. The first patterned conductor 141 a has winding portions of two turns, while the second patterned conductor 142*a* has a winding portion of one turn. The first patterned conductor 141*a* and the second patterned conductor 142*a* are wound in opposite directions. The inner ends of the patterned conductors 141*a* and 142*a* are electrically connected to each other via a through-hole 147. Thus, the patterned conductors 141*a* and 142*a* form a winding of three turns.

Figure 29:
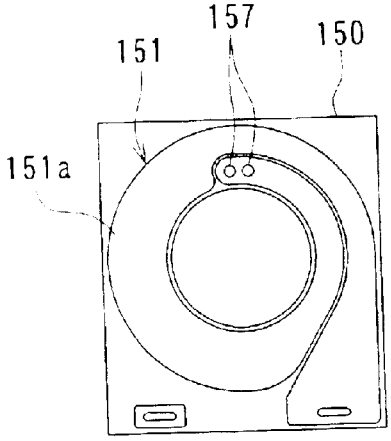
FIG. 29 is a top view showing a first conductor layer and an insulating layer below the same of a planar coil of a sixth comparative example.
Figure 30:
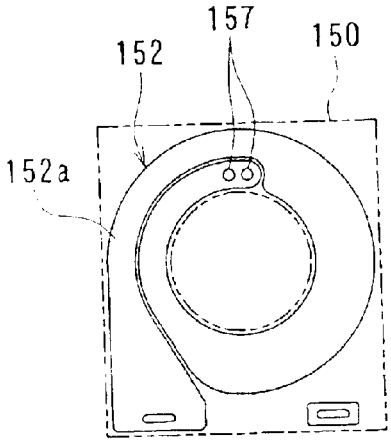
FIG. 30 is a top view showing a second conductor layer of the planar coil of the sixth comparative example.

FIG. 29 is a top view showing a first conductor layer and an insulating layer below the same of a planar coil of a sixth comparative example. FIG. 30 is a top view showing a second conductor layer of the planar coil of the sixth comparative example. The planar coil of the sixth comparative example comprises an insulating layer 150, and a first conductor layer 151 and a second conductor layer 152 formed on the surfaces of the insulating layer 150. The first conductor layer 151 includes a first patterned conductor 151*a*, while the second conductor layer 152 includes a second patterned conductor 152*a*. The first patterned conductor 151*a* has winding portions of 1.5 turns, and the second patterned conductor 152*a* also has winding portions of 1.5 turns. The first patterned conductor 151*a* and the second patterned conductor 152*a* are wound in opposite directions. The inner ends of the patterned conductors 151*a* and 152*a* are electrically connected to each other via a through-hole 157. Thus, the patterned conductors 151*a* and 152*a* form a winding of three turns.

For each of the planar coils of the third working example, the fourth working example, the fifth comparative example and the sixth comparative example, copper was used as the conductor constituting the winding, thickness t of the conductor was set to 0.06 mm, the inner radius $r_{min}$ of the innermost winding portion was set to 6.4 mm, a difference $W_{total}$ between the outer radius of the outermost winding portion and the inner radius of the innermost winding portion was set to 5.1 mm, and a distance D between winding portions at adjacent turns was set to 0.2 mm. Under these conditions, values of the inner radius $r_i(n)$ and the outer radius $r_o(n)$ for a winding portion at each turn and a resistance value $R_{total}$ of the entire winding were determined for each planar coil. The volume resistivity of the copper was set to $1.72\times10^{-8}$ (Ωm). The width $r_o(n)-r_i(n)$ of a winding portion at each turn is hereinafter expressed as W(n).

For each of the planar coils of the third working example, the fourth working example and the fifth comparative example, the width W(n) of a winding portion at each turn and the resistance value $R_{total}$ of the entire winding are as shown in the following table. In the table, the first conductor layer is referred to as "layer A" and the second conductor layer is referred to as "layer B". According to the planar coil of the sixth comparative example, the ratio of the width of the portion forming the conductive path corresponding to two turns in $W_{total}$ to the width of the portion forming the conductive path corresponding to one turn in $W_{total}$ is the same as that of the fifth comparative example. Thus, in principle, the resistance value is equivalent to that of the fifth comparative example.

| | Third working example | Fourth comparative example | Fifth comparative example |
|---|---|---|---|
| $R_{total}$ (mΩ) | 14.74 | 14.46 | 16.15 |
| Layer A | 1.63 | 1.33 | 2.45 |

-continued

| | Third working example | Fourth comparative example | Fifth comparative example |
|---|---|---|---|
| W(1) (mm) Layer A | 3.27 | 3.57 | 2.45 |
| W(2) (mm) Layer B | 1.63 | 1.33 | 5.10 |
| W(1) (mm) Layer B | 3.27 | 3.57 | — |
| W(2) (mm) | | | |

As can be seen from the table above, for the planar coil of the third working example, the resistance value $R_{total}$ of the entire winding is reduced by 8.71% compared with the planar coil of the fifth comparative example. For the planar coil of the fourth working example, the resistance value $R_{total}$ of the entire winding is reduced by 10.45% compared with the planar coil of the fifth comparative example.

In the third working example, the width W(1) of the inner winding portion is 0.5 times the width W(2) of the outer winding portion. As for the fourth working example, the width W(n) of a winding portion at each turn being determined so as to minimize the value of A expressed by the equation (5), in the aforementioned example the width W(1) of the inner winding portion is 0.37 times the width W(2) of the outer winding portion. However, the resistance value $R_{total}$ of the entire winding can be made lower than that of the planar coil of the fifth comparative example even when the ratio of the width W(1) of the inner winding portion to the width W(2) of the outer winding portion, i.e., W(1)/W(2), is not equal to 0.5 or 0.37. This will be discussed with reference to FIG. 31 and FIG. 32.

Figure 31:
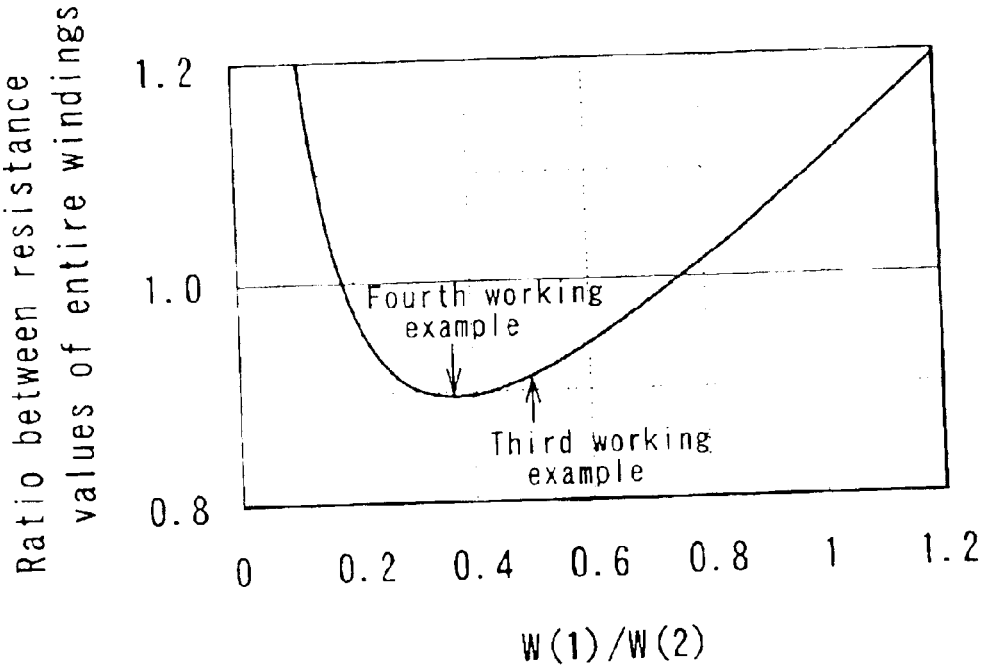
FIG. 31 is a plot illustrating an example of variations in a ratio between a resistance value of an entire winding of the invention and a resistance value of an entire winding of the comparative example, as the widths of winding portions are changed from turn to turn.

FIG. 31 is a plot showing a ratio of the resistance value $R_{total}$ of the entire winding to the resistance value $R_{total}$ of the entire winding of the fifth comparative example, as the W(1)/W(2) is varied and conditions other than the widths W(1) and W(2) of the winding portions are remained the same as those in the third working example, the fourth working example, and the fifth comparative example. From FIG. 31, it can be seen that under the aforementioned conditions, the ratio of the aforementioned resistance values is one or less in a wide range of the W(1)/W(2) from 0.18 to 0.75. Accordingly, in this case, the resistance value $R_{total}$ of the entire winding can be smaller than that of the fifth comparative example when the W(1)/W(2) is greater than 0.18 and less than 0.75.

The range of W(1)/W(2) in which the aforementioned ratio of resistance values becomes less than or equal to one varies depending on the values of $r_{min}$, $W_{total}$, and D. For example, consider the case where $r_{min}$ is 3 mm with the other conditions being the same as those employed for determining the plot of FIG. 31. Additionally, as a comparative example for this case, consider a case where $r_{min}$ is 3 mm with the other conditions being the same as those of the fifth comparative example. The ratio of the resistance value $R_{total}$ of the entire winding of this case to the resistance value $R_{total}$ of the entire winding of the comparative example, as the W(1)/W(2) is varied, is plotted in FIG. 32. In this case, from FIG. 32, it can be seen that the ratio of the aforementioned resistance values is one or less in a wide range of the W(1)/W(2) ranges from 0.13 to 0.68. Accordingly, in this case, the resistance value $R_{total}$ of the entire winding can be smaller than that of the comparative example when the W(1)/W(2) is greater than 0.13 and less than 0.68.

Figure 32:
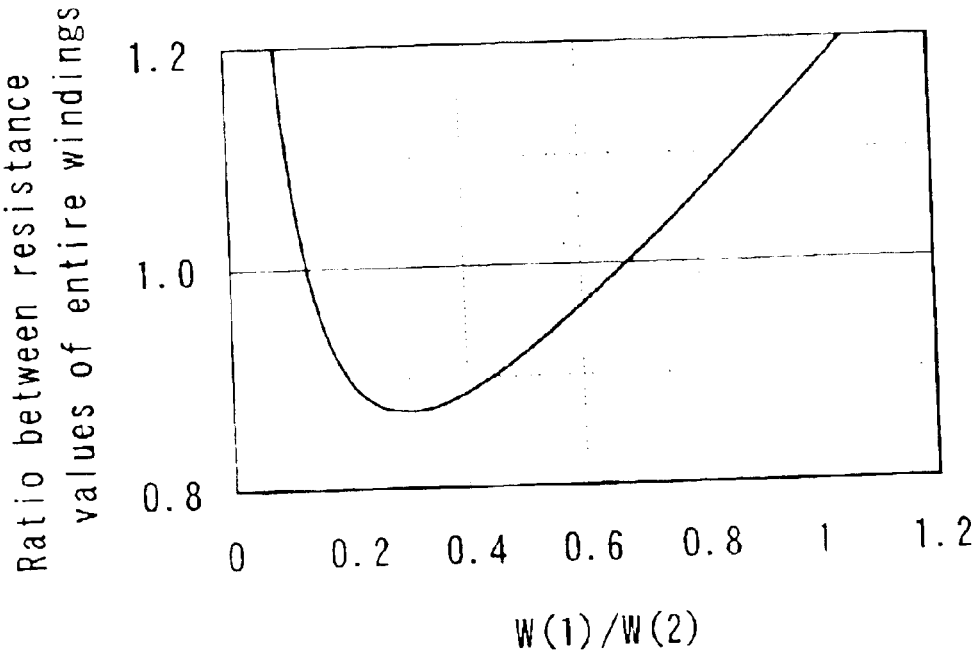
FIG. 32 is a plot illustrating another example of variations in the ratio between a resistance value of the entire winding of the invention and a resistance value of the entire winding of the comparative example, as the widths of winding portions are changed from turn to turn.

According to the invention, it is thus possible to reduce the resistance value $R_{total}$ of the entire winding in such a wide range as shown in FIGS. 31 and 32, irrespective of whether the width of the innermost winding portion is substantially half that of the other winding portions in the first patterned conductor and the second patterned conductor, or whether the $r_i(n)$ and $r_o(n)$ are determined so as to minimize the value of A expressed by the equation (5).

[Sixth Embodiment]

Figure 33:
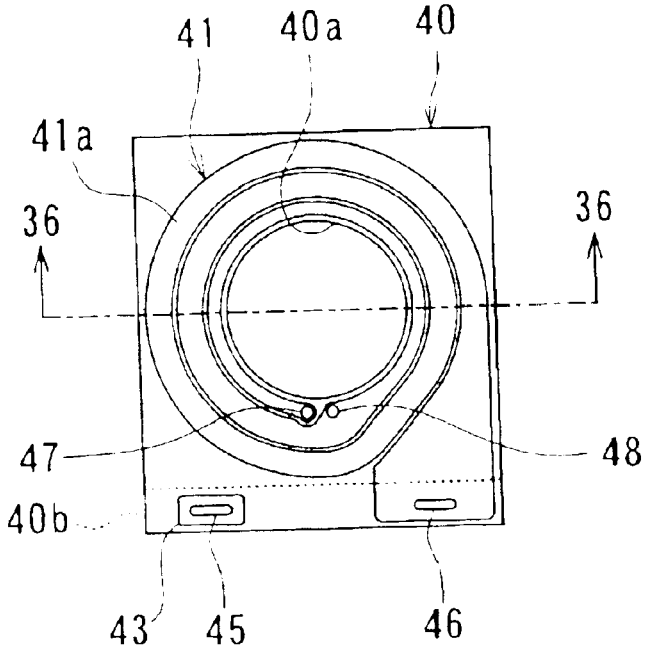
FIG. 33 is a top view showing a first conductor layer and an insulating layer below the same of a planar coil according to a sixth embodiment of the invention.
Figure 34:
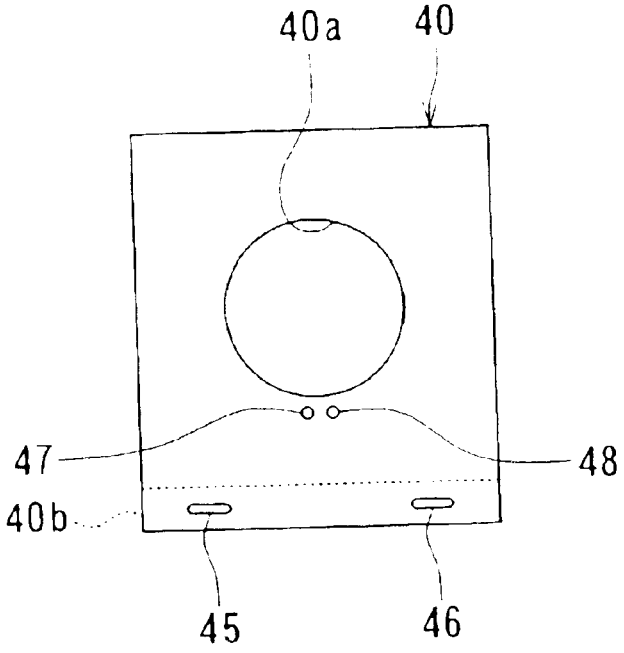
FIG. 34 is a top view showing the insulating layer of the planar coil according to the sixth embodiment of the invention.
Figure 35:
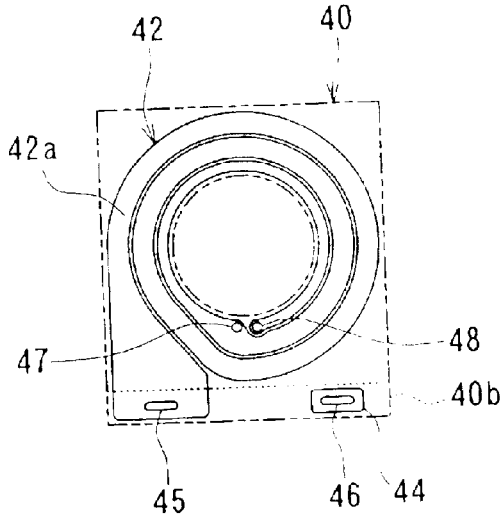
FIG. 35 is a top view showing a second conductor layer of the planar coil according to the sixth embodiment of the invention.
Figure 36:
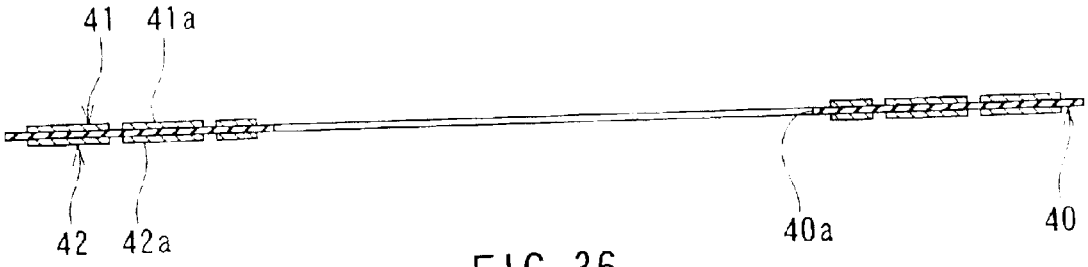
FIG. 36 is an enlarged cross-sectional view taken along line 36—36 of FIG. 33.

Reference is now made to FIG. 33 to FIG. 36 to describe a configuration of a planar coil according to a sixth embodiment of the invention. FIG. 33 is a top view showing a first conductor layer and an insulating layer below the same of the planar coil according to the present embodiment; FIG. 34 is a top view showing the insulating layer of the planar coil according to the embodiment; FIG. 35 is a top view showing a second conductor layer of the planar coil according to the embodiment; and FIG. 36 is an enlarged cross-sectional view taken along line 36—36 of FIG. 33.

The planar coil according to the present embodiment is configured so that N=2. That is, the first patterned conductor 41*a* and the second patterned conductor 42*a* each include winding portions of three turns. Then, the first patterned conductor 41*a* and the second patterned conductor 42*a* form a winding of 2N+1=5 turns. In each of the first patterned conductor 41*a* and the second patterned conductor 42*a*, the innermost winding portion is substantially half the width of the other winding portions. The other winding portions have constant widths. The remainder of the configuration, functions and effects of this embodiment are the same as those of the fourth embodiment.

[Seventh Embodiment]

Figure 37:
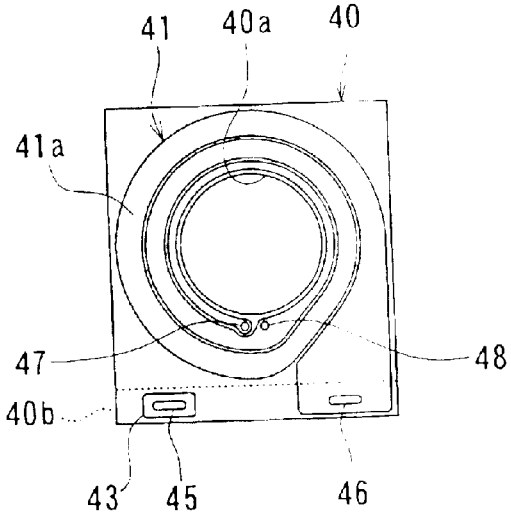
FIG. 37 is a top view showing a first conductor layer and an insulating layer below the same of a planar coil according to a seventh embodiment of the invention.
Figure 38:
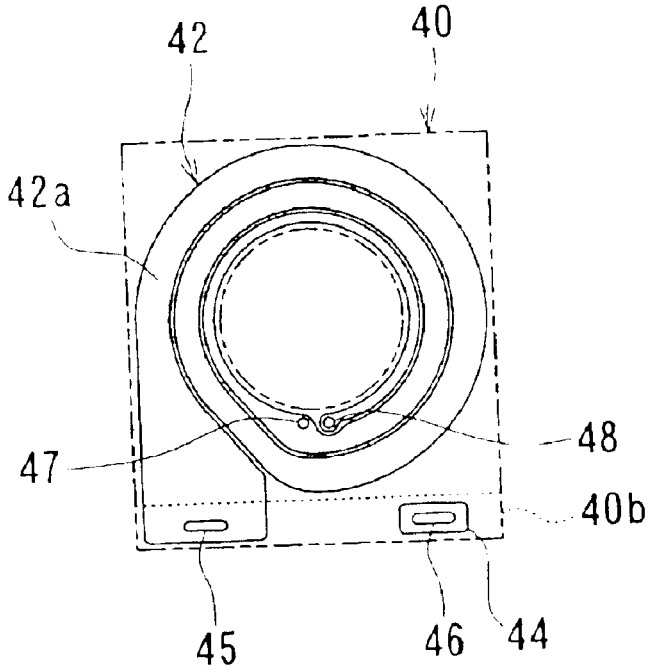
FIG. 38 is a top view showing a second conductor layer of the planar coil according to the seventh embodiment of the invention.

Reference is now made to FIG. 37 and FIG. 38 to describe a configuration of a planar coil according to a seventh embodiment of the invention. FIG. 37 is a top view showing a first conductor layer and an insulating layer below the same of the planar coil according to the present embodiment. FIG. 38 is a top view showing a second conductor layer of the planar coil according to the embodiment.

The configuration of the planar coil according to the present embodiment is the same as that of the planar coil according to the sixth embodiment except that the patterned conductors 41*a* and 42*a* are different in shape.

According to the planar coil of the present embodiment, like that of the fifth embodiment, in the first patterned conductor 41*a* and the second patterned conductor 42*a*, letting $r_i(n)$ be the radius of the inner circumference of a winding portion at the $n^{th}$ turn (n is an integer greater than or equal to 1 and less than or equal to N+1) from the inner side; $r_o(n)$ be the radius of the outer circumference of the same; $r_{min}$ be the radius of the inner circumference of the innermost winding portion; $W_{total}$ be a difference between the radius of the outer circumference of the outermost winding portion and the radius of the inner circumference of the innermost winding portion; and D be a distance between winding portions at adjacent turns, the $r_i(n)$ and $r_o(n)$ are determined so as to minimize the value of A given by the equation (5) when the $r_{min}$, $W_{total}$ and D are given.

The remainder of the configuration, functions and effects of this embodiment are the same as those of the fifth or sixth embodiment.

Now, explained below are an example of the planar coil according to the sixth embodiment (hereinafter referred to as a fifth working example) and an example of the planar coil according to the seventh embodiment (hereinafter referred to as a sixth working example), and the results of comparison of calculated resistance values between the planar coils of the working examples and a planar coil of a seventh comparative example.

Figure 39:
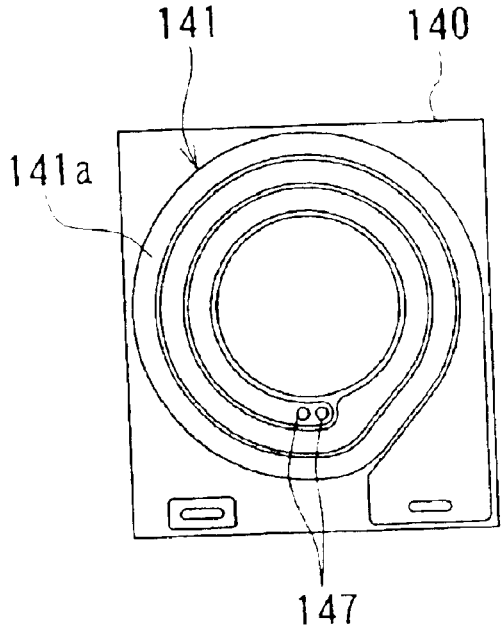
FIG. 39 is a top view showing a first conductor layer and an insulating layer below the same of a planar coil of a seventh comparative example.
Figure 40:
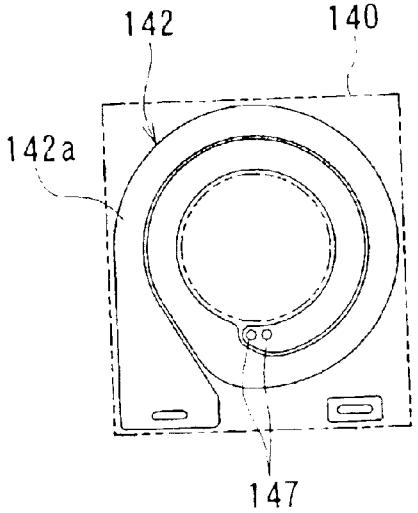
FIG. 40 is a top view showing a second conductor layer of the planar coil of the seventh comparative example.

FIG. 39 is a top view showing a first conductor layer and an insulating layer below the same of the planar coil of the seventh comparative example. FIG. 40 is a top view showing a second conductor layer of the planar coil of the seventh comparative example. The planar coil of the seventh comparative example comprises the insulating layer 140, and the first conductor layer 141 and the second conductor layer 142 formed on the surfaces of the insulating layer 140. The first conductor layer 141 includes the first patterned conductor 141*a*, while the second conductor layer 142 includes the second patterned conductor 142*a*. The first patterned conductor 141*a* has winding portions of three turns, while the second patterned conductor 142*a* has winding portions of two turns. The first patterned conductor 141*a* and the second patterned conductor 142*a* are wound in opposite directions. The inner ends of the patterned conductors 141*a* and 142*a* are electrically connected to each other via the through-hole 147. Thus, the patterned conductors 141*a* and 142*a* form a winding of five turns.

For each of the planar coils of the fifth working example, the sixth working example and the seventh comparative example, copper was used as the conductor constituting the winding, thickness t of the conductor was set to 0.06 mm, the inner radius $r_{min}$ of the innermost winding portion was set to 6.4 mm, a difference $W_{total}$ between the outer radius of the outermost winding portion and the inner radius of the innermost winding portion was set to 5.1 mm, and a distance D between winding portions at adjacent turns was set to 0.2 mm. Under these conditions, values of the inner radius $r_i(n)$ and the outer radius $r_o(n)$ for a winding portion at each turn and a resistance value $R_{total}$ of the entire winding were determined for each planar coil. The volume resistivity of the copper was set to $1.72\times10^{-8}$ (Ωm). The width $r_o(n)-r_i(n)$ of a winding portion at each turn is hereinafter expressed as W(n).

For each of the planar coils of the fifth working example, the sixth working example and the seventh comparative example, the width W(n) of a winding portion at each turn and the resistance value $R_{total}$ of the entire winding are as shown in the following table. In the table, the first conductor layer is referred to as "layer A" and the second conductor layer is referred to as "layer B."

| | Fifth working example | Sixth comparative example | Seventh comparative example |
|---|---|---|---|
| $R_{total}$ (mΩ) | 42.93 | 41.96 | 43.86 |
| Layer A W(1) (mm) | 0.94 | 0.74 | 1.57 |
| Layer A W(2) (mm) | 1.88 | 1.76 | 1.57 |
| Layer A W(3) (mm) | 1.88 | 2.20 | 1.57 |
| Layer B W(1) (mm) | 0.94 | 0.74 | 2.45 |
| Layer B W(2) (mm) | 1.88 | 1.76 | 2.45 |
| Layer B W(3) (mm) | 1.88 | 2.20 | — |

As can be seen from the table above, for the planar coil of the fifth working example, the resistance value $R_{total}$ of the entire winding is reduced by 2.12% compared with the planar coil of the seventh comparative example. For the planar coil of the sixth working example, the resistance value $R_{total}$ of the entire winding is reduced by 4.35% compared with the planar coil of the seventh comparative example. When the first and second patterned conductors each have winding portions of 2.5 turns to form a winding of five turns, the resistance value of the entire winding of the planar coil is equivalent to that of the seventh comparative example.

[Eighth Embodiment]

Figure 41:
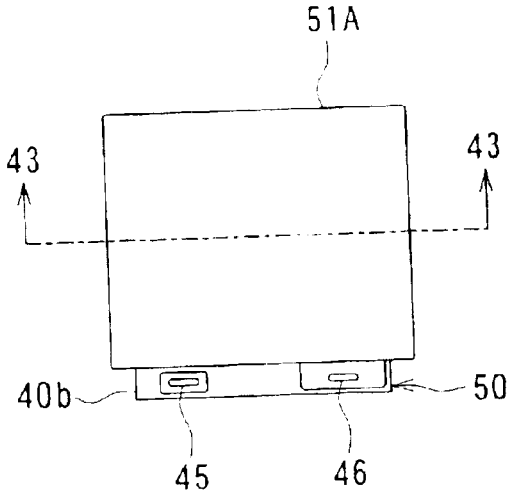
FIG. 41 is a top view of a planar coil according to an eighth embodiment of the invention.
Figure 42:
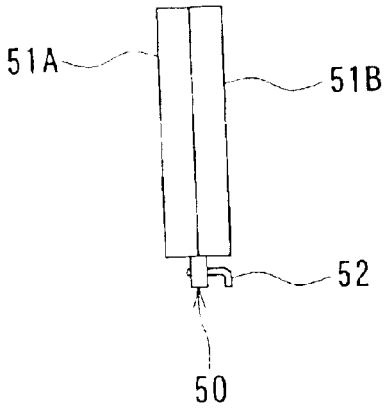
FIG. 42 is a right-hand side view of the planar coil shown in FIG. 41.
Figure 43:
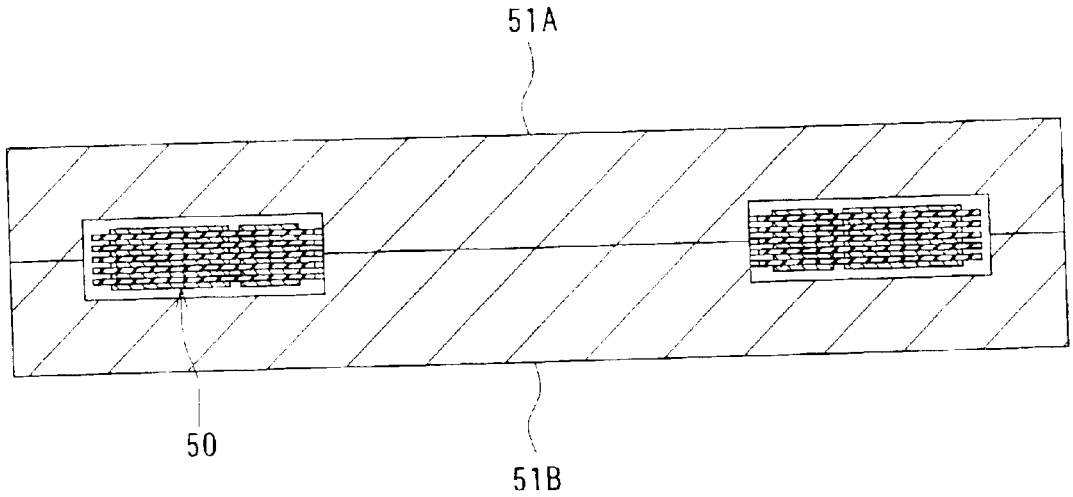
FIG. 43 is an enlarged cross-sectional view taken along line 43—43 of FIG. 41.
Figure 44:
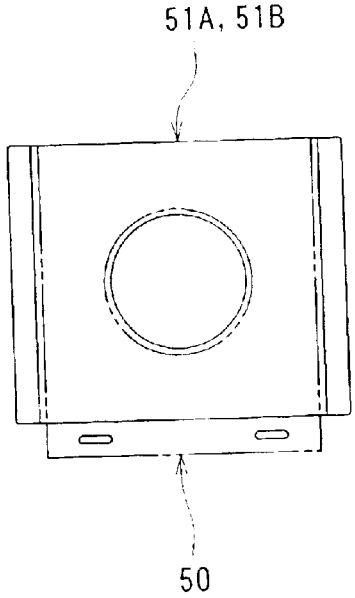
FIG. 44 is a top view showing a core of the planar coil according to the eighth embodiment of the invention.
Figure 45:
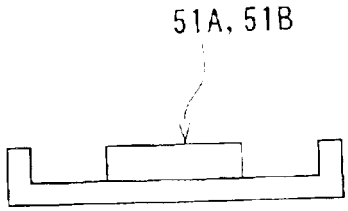
FIG. 45 is a side view of the core of the planar coil according to the eighth embodiment of the invention.

Reference is now made to FIG. 41 through FIG. 45 to describe a configuration of a planar coil according to an eighth embodiment of the invention. FIG. 41 is a top view of the planar coil according to the present embodiment; FIG. 42 is a right-hand side view of the planar coil shown in FIG. 41; FIG. 43 is an enlarged cross-sectional view taken along line 43—43 of FIG. 41; FIG. 44 is a top view showing a core of the planar coil according to the embodiment; and FIG. 45 is a side view of the core.

In the planar coil of the present embodiment, the insulating layer 40, the first conductor layer 41, and the second conductor layer 42 of the fourth or fifth embodiment are combined to make one set, and three sets of them are stacked in a direction of thickness, with the windings of the respective sets being connected in parallel to each other. The planar coil of the embodiment comprises a stacked body 50 made up of the stacked three sets of the insulating layer 40, the first conductor layer 41 and the second conductor layer 42, and E-type cores 51A and 51B attached to the stacked body 50.

As shown in FIG. 41 and FIG. 42, the terminal area 40*b* is located outside the cores 51A and 51B. The windings of the respective sets in the stacked body 50 are connected in parallel to each other via the through-holes 45 and 46. For example, as shown in FIG. 42, each of the through-holes 45 and 46 is configured such that a terminal 52 is inserted therein.

Additionally, as shown in FIG. 43, the E-type cores 51A and 51B are disposed to allow their central projections to butt against each other through the hole 40*a* of the insulating layer 40.

The remainder of the configuration, functions and effects of the present embodiment are the same as those of the fourth or fifth embodiment.

[Ninth Embodiment]

Figure 46:
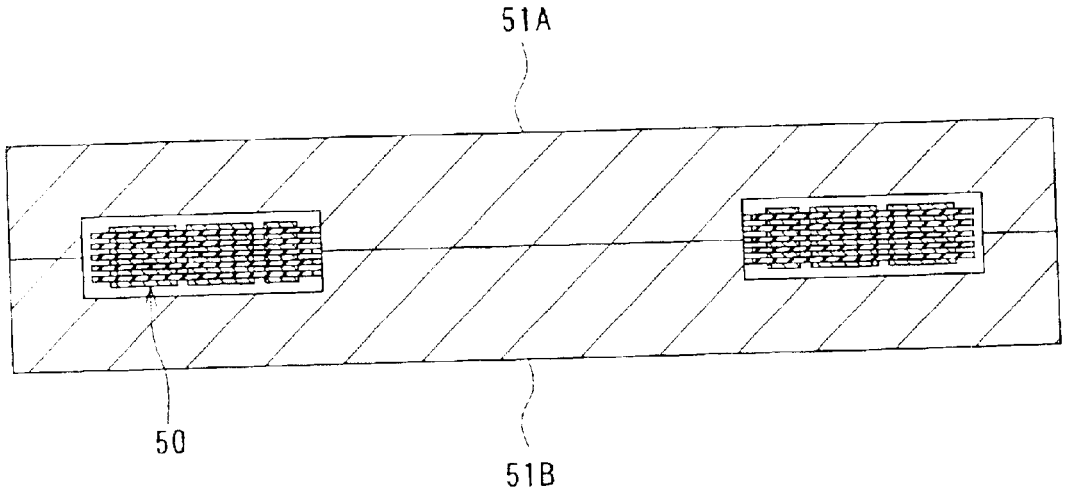
FIG. 46 is a cross-sectional view of a planar coil according to a ninth embodiment of the invention.

Reference is now made to FIG. 46 to describe a configuration of a planar coil according to a ninth embodiment of the invention. FIG. 46 is a top view of the planar coil according to the embodiment. The planar coil according to the embodiment is provided with such a stacked body 50 as described below, instead of the stacked body 50 of the eighth embodiment. Specifically, in the present embodiment, the insulating layer 40, the first conductor layer 41 and the second conductor layer 42 of the sixth or seventh embodiment are combined to make one set, and three sets of them are stacked in a direction of thickness, with the windings of the respective sets being connected in parallel to each other, thereby forming the stacked body 50.

As an example of the planar coil of the present embodiment (hereinafter referred to as a seventh working example), a prototype planar coil was fabricated including the stacked body 50 formed by stacking three sets of the planar coil of the fifth working example, with the windings of the respective sets connected in parallel to each other. The resistance of the entire winding of the prototype planar coil of the seventh working example measured 15.05 mΩ.

Figure 47:
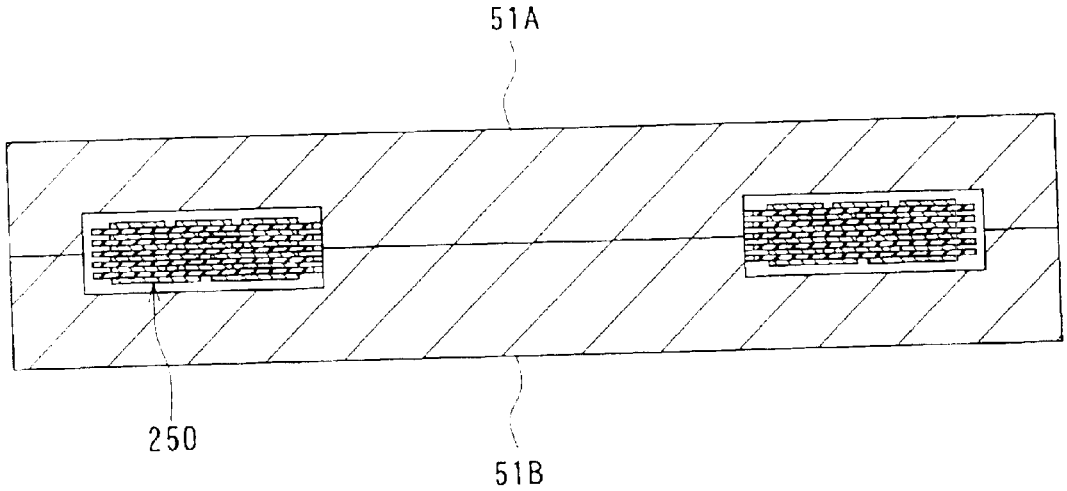
FIG. 47 is a cross-sectional view of a planar coil of an eighth comparative example.

As a comparative example (hereinafter referred to as an eighth comparative example) against the seventh working example, a prototype planar coil was fabricated including a stacked body 250 formed by stacking three sets of the planar coil of the seventh comparative example, with the windings of the respective sets connected in parallel to each other. FIG. 47 is a cross-sectional view of the planar coil of the eighth comparative example. Except for the stacked body 250, the configuration of the planar coil of the eighth comparative example is the same as that of the planar coil of the seventh working example. The resistance of the entire winding of the planar coil of the eighth comparative example measured 15.38 mΩ.

Thus, the rate of reduction in resistance of the planar coil of the seventh working example is 2.15% as compared with the planar coil of the eighth comparative example, which is equivalent to the rate of reduction in resistance of the planar coil of the fifth working example against the planar coil of the seventh comparative example.

The remainder of the configuration, functions and effects of the present embodiment are the same as those of the sixth, seventh, or eighth embodiment.

[Tenth Embodiment]

Figure 48:
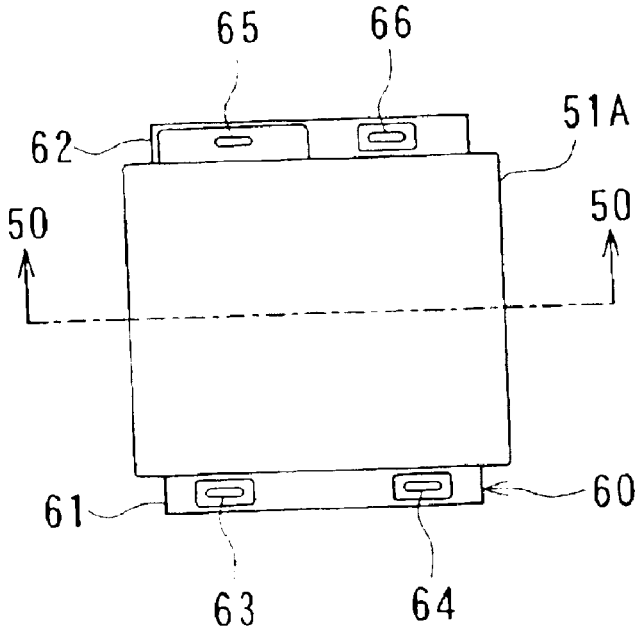
FIG. 48 is a top view of a planar transformer according to a tenth embodiment of the invention.
Figure 49:
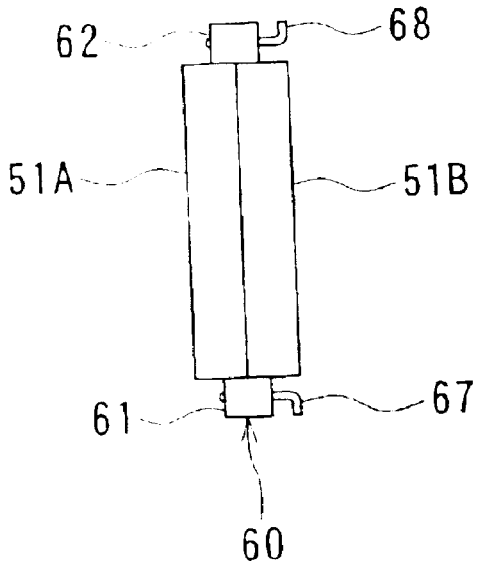
FIG. 49 is a right-hand side view of the planar transformer shown in FIG. 48.
Figure 50:
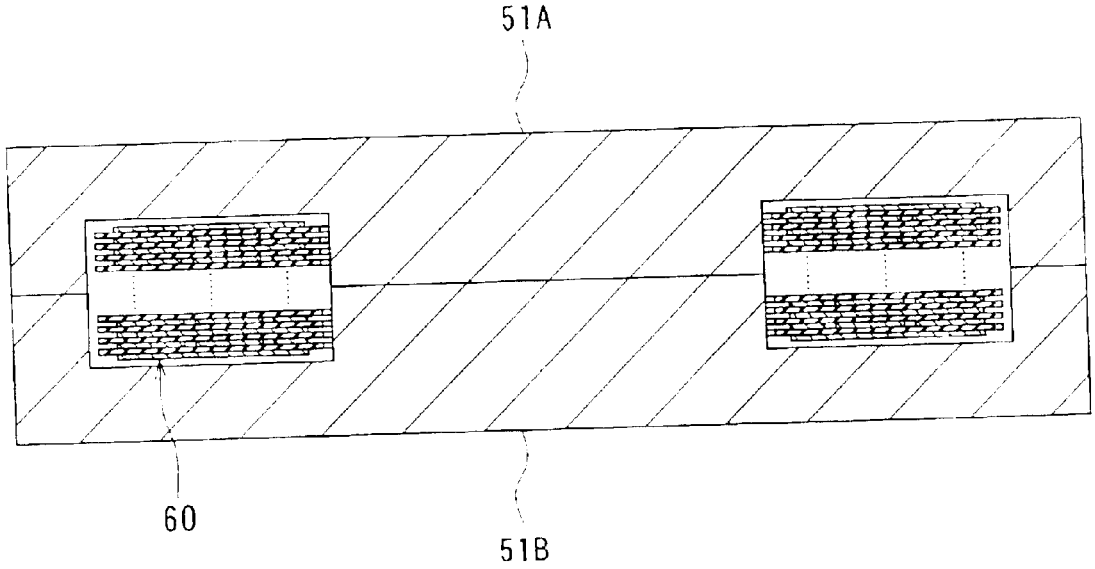
FIG. 50 is an enlarged cross-sectional view taken along line 50—50 of FIG. 48.

Now, description will be given of a configuration of a planar transformer according to a tenth embodiment of the invention. FIG. 48 is a top view of the planar transformer according to the embodiment; FIG. 49 is a right-hand side view of the planar transformer shown in FIG. 48; and FIG. 50 is an enlarged cross-sectional view taken along line 50—50 of FIG. 48. The planar transformer according to the embodiment has a primary winding and a secondary winding each formed of a conductor arranged into a flat shape. As shown in FIG. 48 to FIG. 50, the planar transformer according to the embodiment comprises a stacked body 60 formed by alternately stacking a plurality of conductor layers and a plurality of insulating layers, and the E-type cores 51A and 51B attached to the stacked body 60.

As shown in FIG. 48 and FIG. 49, the stacked body has terminal areas 61 and 62. The terminal areas 61 and 62 are located outside the cores 51A and 51B, at positions opposite to each other. Through-holes 63 and 64 are provided in the terminal area 61, while through-holes 65 and 66 are provided in the terminal area 62. As shown in FIG. 49, for example, each of the through-holes 63 and 64 is configured such that a terminal 67 is inserted therein, and each of the through-holes 65 and 66 is configured such that a terminal 68 is inserted therein.

Additionally, as shown in FIG. 50, the E-type cores 51A and 51B are disposed to allow their central projections to butt against each other through a hole 70*a* of insulating layers 70 to be described later.

The stacked body 60 includes four types of conductor layers, i.e., a PA layer, a PB layer, an SA layer, and an SB layer, and the insulating layers 70. The four types of conductor layers each include a patterned conductor that is formed by arranging a plate-like conductor, including a foil-like conductor, into a flat-spiral shape. The PA layer and the PB layer form the primary winding of five turns, while the SA layer and the SB layer form the secondary winding of two turns. Therefore, the planar transformer according to the embodiment has a turns ratio of 5:2.

Figure 51:
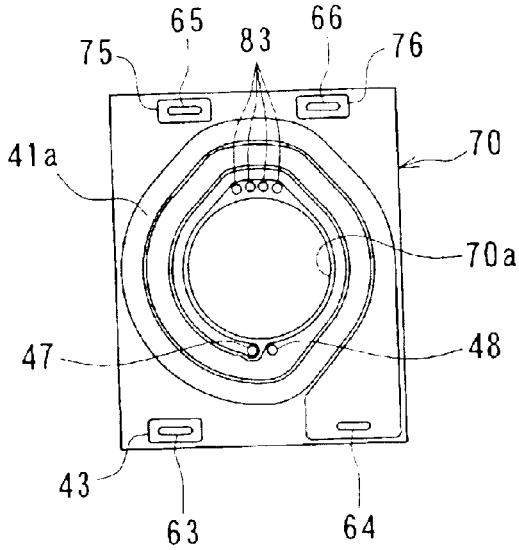
FIG. 51 is a top view showing a PA layer and an insulating layer below the same of the planar transformer according to the tenth embodiment of the invention.
Figure 52:
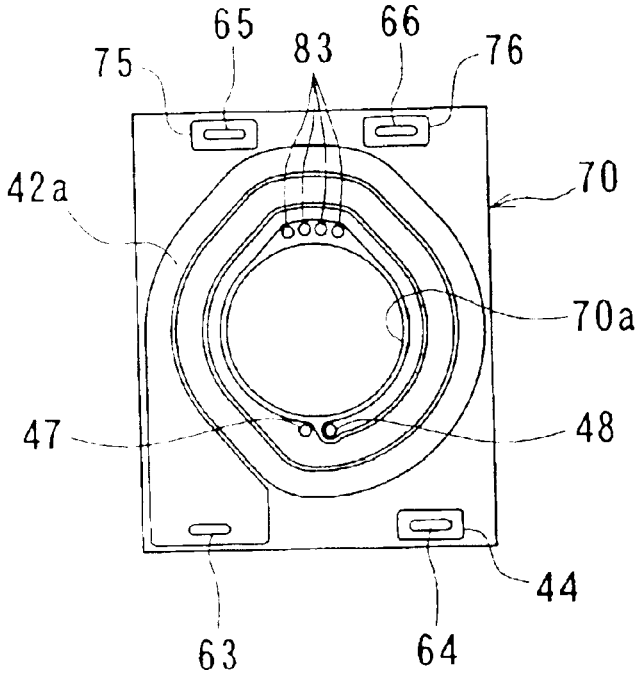
FIG. 52 is a top view showing a PB layer and an insulating layer below the same of the planar transformer according to the tenth embodiment of the invention.
Figure 53:
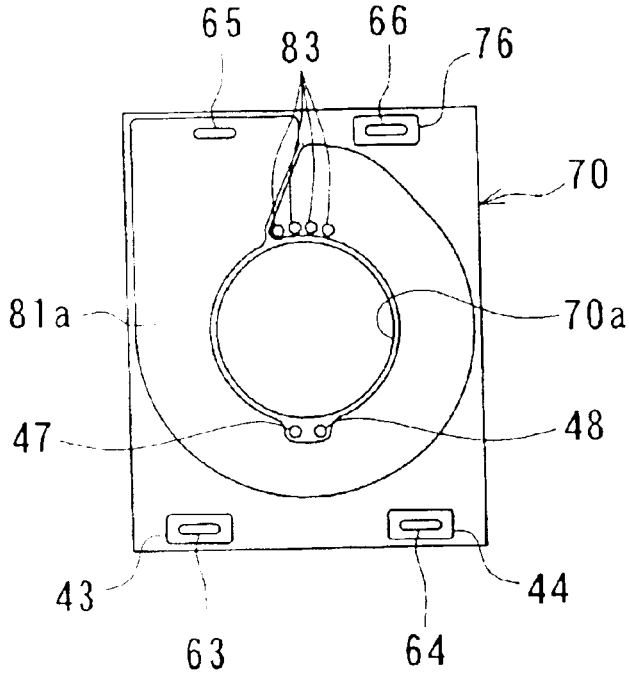
FIG. 53 is a top view showing an SA layer and an insulating layer below the same of the planar transformer according to the tenth embodiment of the invention.
Figure 54:
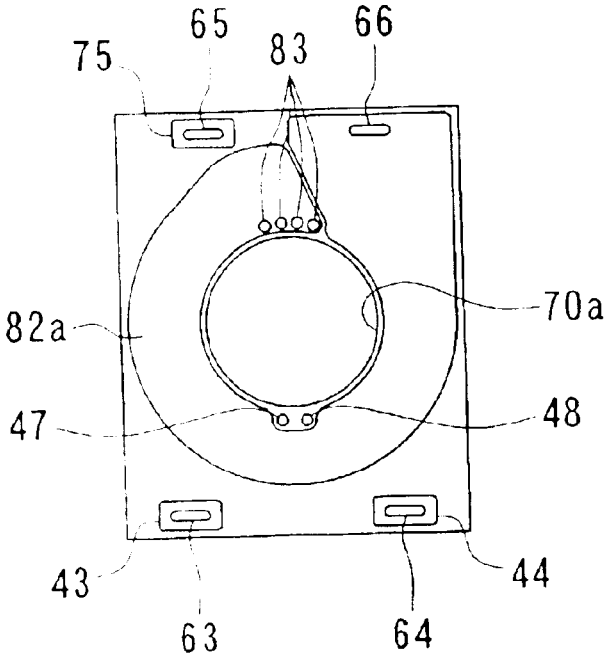
FIG. 54 is a top view showing an SB layer and an insulating layer below the same of the planar transformer according to the tenth embodiment of the invention.
Figure 55:
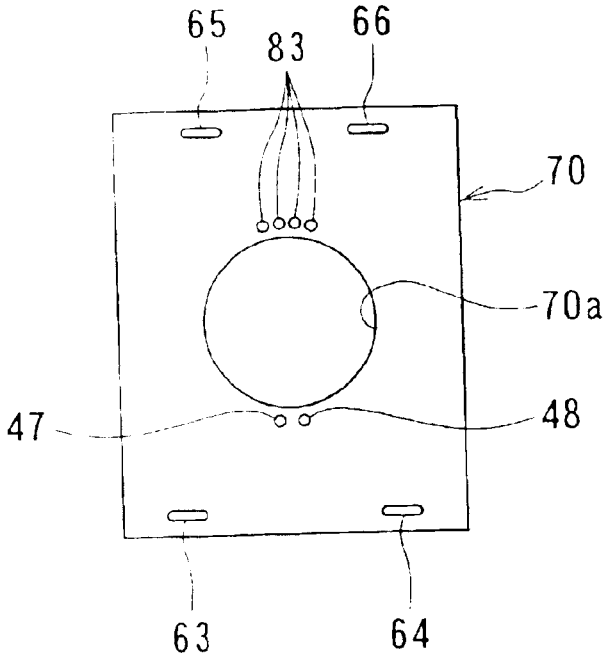
FIG. 55 is a top view of the insulating layer of the planar transformer according to the tenth embodiment of the invention.

FIG. 51 is a top view showing the PA layer and the insulating layer 70 below the same; FIG. 52 is a top view showing the PB layer and the insulating layer 70 below the same; FIG. 53 is a top view showing the SA layer and the insulating layer 70 below the same; FIG. 54 is a top view showing the SB layer and the insulating layer 70 below the same; and FIG. 55 is a top view of the insulating layer 70.

As shown in FIG. 51, the PA layer includes a first patterned conductor 41*a* similar to that of the sixth or seventh embodiment. As shown in FIG. 52, the PB layer includes a second patterned conductor 42*a* similar to that of the sixth or seventh embodiment. That is, the first patterned conductor 41*a* and the second patterned conductor 42*a* each include winding portions of three turns. The first patterned conductor 41*a* and the second patterned conductor 42*a* are wound in opposite directions. Additionally, the innermost winding portions of the first patterned conductor 41*a* and the second patterned conductor 42*a* are connected in parallel to each other via the through-holes 47 and 48 that penetrate the patterned conductors 41*a* and 42*a* and the insulating layer 70. Thus, the first patterned conductor 41*a* and the second patterned conductor 42*a* form the primary winding of five turns.

As shown in FIG. 51, the outer end of the first patterned conductor 41*a* is connected to a through-hole 64. On the surface of the insulating layer 70 on which the first patterned conductor 41*a* is provided, there are provided terminal layers 43, 75, and 76 that are connected to through-holes 63, 65, and 66, respectively.

As shown in FIG. 52, the outer end of the second patterned conductor 42*a* is connected to the through-hole 63. On the surface of the insulating layer 70 on which the second patterned conductor 42*a* is provided, there are provided terminal layers 44, 75, and 76 that are connected to the through-holes 64, 65, and 66, respectively.

As shown in FIG. 53 and FIG. 54, the 5A layer and the 5B layer include patterned conductors 81*a* and 82*a*, respectively. The patterned conductors 81*a* and 82*a* each have a winding portion of one turn. The patterned conductors 81*a* and 82*a* are wound in opposite directions. One end of the patterned conductor 81*a* is connected to the through-hole 65. On the surface of the insulating layer 70 on which the patterned conductor 81*a* is provided, there are provided terminal layers 43, 44, and 76 that are connected to the through-holes 63, 64, and 66, respectively. One end of the patterned conductor 82*a* is connected to the through-hole 66. On the surface of the insulating layer 70 on which the patterned conductor 82*a* is provided, there are provided terminal layers 43, 44, and 75 that are connected to the through-holes 63, 64, and 65, respectively. The other ends of the patterned conductors 81*a* and 82*a* are electrically connected to each other via through-holes 83 that penetrate the patterned conductors 81*a* and 82*a* and the insulating layer 70. Thus, the patterned conductors 81*a* and 82*a* form the secondary winding of two turns.

As shown in FIG. 55, there is formed a circular hole 70*a* at the central portion of each insulating layer 70. The patterned conductors are each disposed in an area between the perimeter of the hole 70*a* and the perimeter of the respective insulating layers 70. In the insulating layers 70, there are formed the through-holes 77, 78, 63 to 66, and 83 mentioned above.

The PA layer, PB layer, SA layer and SB layer are stacked in the following order from the bottom: SA layer-PA layer-SB layer-PB layer-SA layer-PA layer-SB layer-SA layer-PB layer-SB layer-PA layer-SA layer-PB layer-SB layer.

As an example of the planar transformer according to the present embodiment (hereinafter referred to as an eighth working example), a prototype planar transformer was fabricated in which the first patterned conductor 41*a* and the second patterned conductor 42*a* of the fifth working example were used for the PA layer and the PB layer, respectively, each insulating layer 70 was 0.1 mm in thickness, and the cores 51A and 51B were made of ferrite. In the prototype planar transformer of the eighth working example, the winding resistance at 200 kHz as viewed from the primary side measured 36.82 mΩ.

Figure 56:
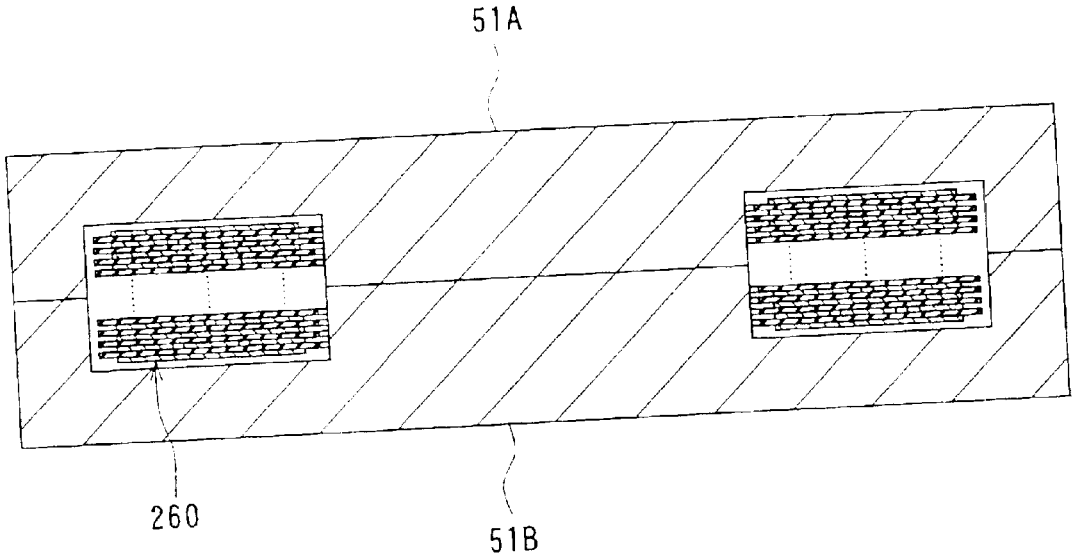
FIG. 56 is a cross-sectional view of a planar transformer of a ninth comparative example.

As a comparative example (hereinafter referred to as a ninth comparative example) against the eighth working example, a prototype planar transformer was fabricated including a stacked body 260 in which the first patterned conductor 141*a* and the second patterned conductor 142*a* of the seventh comparative example were used for the PA layer and the PB layer, respectively, and each insulating layer 70 was 0.1 mm in thickness, with the cores 51A and 51B made of ferrite. FIG. 56 is a cross-sectional view of the planar transformer of the ninth comparative example. In the prototype planar transformer of the ninth comparative example, the winding resistance at 200 kHz as viewed from the primary side measured 37.81 mΩ.

Thus, as compared with the planar transformer of the ninth comparative example, the planar transformer of the eighth working example has attained a 2.6% reduction in the high-frequency resistance at 200 kHz.

In the present embodiment, the primary winding has an odd number of turns (five turns) and the secondary winding has an even number of turns (two turns). However, the primary winding may have an even number of turns and the secondary winding may have an odd number of turns. Alternatively, both the primary and secondary windings may have an odd number of turns.

The remainder of the configuration, functions and effects of the present embodiment are the same as those of the sixth or seventh embodiment.

In the fourth to tenth embodiments, the number of turns of the winding or the patterned conductors, and the number of the conductor layers can be set to any number.

Additionally, in the fourth to tenth embodiments, the winding may be formed of a conductor other than plate-shaped ones, and more specifically, a rounded wire conductor, for example.

As described in the foregoing, according to the fourth to tenth embodiments, in the first and second patterned conductors each including winding portions of N+1 turns, the innermost winding portions of the first and second patterned conductors are connected in parallel to each other so as to form a winding of 2N+1 turns. Accordingly, in the fourth to tenth embodiments, the first patterned conductor and the second patterned conductor may be formed into the same pattern in terms of width. In the fourth to tenth embodiments, the conductive path corresponding to one turn that is formed by the innermost winding portions of the first and second patterned conductors is twice as thick as the other conductive path. However, by adjusting the width thereof, it is possible to reduce the resistance value of the entire winding of 2N+1 turns, and to thereby reduce a loss in the entire winding. From the foregoing, the fourth to tenth embodiments make it possible to achieve a reduction in thickness of the planar coil or the planar transformer, great flexibility in designing the number of conductor layers, and a reduction in loss.

In the fourth to tenth embodiments, the innermost winding portion of each of the first and second patterned conductors may have a width that is substantially half the width of another winding portion. In this case, it is possible to uniformalize a current density for every portion of the winding of 2N+1 turns, and as a result, it is possible to reduce a loss in the winding further.

In the fourth to tenth embodiments, for the first patterned conductor and the second patterned conductor, the $r_i(n)$ and $r_o(n)$ may be set so as to minimize the value of A given by the equation (5). In this case, it is possible to minimize the resistance value of the entire winding, and as a result, it is possible to minimize a loss in the entire winding.

It is apparent that the present invention may be carried out in various modes and may be modified in various manners based on the foregoing description. Therefore, within the scope of equivalence of the scope of the following claims, the invention may be practiced otherwise than as specifically described.

What is claimed is:

1. A planar coil comprising a winding formed by arranging a conductor into a flat-spiral shape, the winding including winding portions of N turns (N is an integer greater than or equal to two), wherein:

letting $r_i(n)$ be a radius of an inner circumference of a winding portion at the $n^{th}$ turn (n is an integer greater than or equal to one and less than or equal to N) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (1) when the $r_{min}$, $W_{total}$ and D are given:

$$A = \sum_{n=1}^{N} \left(\log \frac{r_o(n)}{r_i(n)}\right)^{-1} \tag{1}$$

where $r_i(1)=r_{min}$, $r_i(n+1)-r_o(n)=D$, and $r_o(N)-r_i(1)=W_{total}$.

2. A planar coil according to claim 1, wherein a plurality of said windings are provided, and the plurality of said windings are stacked in a direction of thickness with an insulating layer disposed between adjacent ones, and are connected in parallel or in series to each other.

3. A planar transformer comprising a plurality of windings each formed into a flat shape and stacked in a direction of thickness, and an insulating layer disposed between adjacent ones of the windings, a part of the plurality of windings serving as a primary winding and another part of the plurality of windings serving as a secondary winding, wherein:

at least one of the plurality of windings includes winding portions of N turns (N is an integer greater than or equal to two), the winding portions being formed by arranging a conductor into a flat-spiral shape, and letting $r_i(n)$ be a radius of an inner circumference of a winding portion at the $n^{th}$ turn (n is an integer greater than or equal to one and less than or equal to N) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (1) when the $r_{min}$, $W_{total}$ and D are given:

$$A = \sum_{n=1}^{N} \left(\log \frac{r_o(n)}{r_i(n)}\right)^{-1} \tag{1}$$

where $r_i(1)=r_{min}$, $r_i(n+1)-r_o(n)$ D, and $r_o(N)-r_i(1)=W_{total}$.

4. A planar coil having a winding of an odd number of turns, the winding being formed of a conductor, the planar coil comprising: an insulating layer; a first conductor layer including a first patterned conductor formed by arranging a conductor into a flat-spiral shape; and a second conductor including a second patterned conductor formed by arranging a conductor into a flat-spiral shape, the second conductor layer being adjacent to the first conductor layer via the insulating layer, wherein:

each of the first patterned conductor and the second patterned conductor includes a winding portion of an innermost one turn and the remaining winding portion of N (N is an integer greater than or equal to one) turns, and only the winding portion of the innermost one turn of the first patterned conductor and only the winding portion of the innermost one turn of the second patterned conductor are connected in parallel to each other, thereby allowing the first patterned conductor and the second patterned conductor to form the winding of 2N+1 turns.

5. A planar coil according to claim 4, wherein in each of the first patterned conductor and the second patterned conductor, the winding portion of the innermost one turn has a width that is substantially half the width of the remaining winding portion.

6. A planar coil according to claim 4, wherein in the first patterned conductor and the second patterned conductor, letting $r_i(n)$ be a radius of an inner circumference of a winding portion at the $n^{th}$ turn (n is an integer greater than or equal to 1 and less than or equal to N+1) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (5) when the $r_{min}$, $W_{total}$ and D are given:

$$A = \sum_{n=1}^{N+1} K(n)\left(\log\frac{r_o(n)}{r_i(n)}\right)^{-1} \tag{5}$$

where K(1)=0.5; K(n)=2 when n≧2; $r_i(1)=r_{min}$; $r_i(n+1)-r_o(n)=D$; and $r_o(N+1)-r_i(1)=W_{total}$.

7. A planar coil according to claim 4, wherein a plurality of sets of the insulating layer, the first conductor layer and the second conductor layer are stacked in a direction of thickness, and the windings of the respective sets are connected in parallel to each other.

8. A planar transformer having a primary winding and a secondary winding, each being formed of a conductor arranged into a flat shape, wherein:

at least one of the primary winding and the secondary winding comprises: a first conductor layer including a first patterned conductor formed by arranging a conductor into a flat-spiral shape; and a second conductor including a second patterned conductor formed by arranging a conductor into a flat-spiral shape, the second conductor layer being adjacent to the first conductor layer via an insulating layer, each of the first patterned conductor and the second patterned conductor includes a winding portion of an innermost one turn and the remaining winding portion of N (N is an integer greater than or equal to one) turns, and only the winding portion of the innermost one turn of the first patterned conductor and only the winding portion of the innermost one turn of the second patterned conductor are connected in parallel to each other, thereby allowing the first patterned conductor and the second patterned conductor to form a winding of 2N+1 turns.

9. A planar transformer according to claim 8, wherein in each of the first patterned conductor and the second patterned conductor, the winding portion of the innermost one turn has a width that is substantially half the width of the remaining winding portion.

10. A planar transformer according to claim 8, wherein in the first patterned conductor and the second patterned conductor, letting $r_i(n)$ be a radius of an inner circumference of a winding portion at the $n^{th}$ turn (n is an integer greater than or equal to 1 and less than or equal to N+1) from the inner side; $r_o(n)$ be a radius of an outer circumference of the same; $r_{min}$ be a radius of an inner circumference of the innermost winding portion; $W_{total}$ be a difference between a radius of an outer circumference of the outermost winding portion and the radius of the inner circumference of the innermost winding portion; and D be a distance between winding portions at adjacent turns, the $r_i(n)$ and $r_o(n)$ are determined so as to minimize a value of A expressed by equation (5) when the $r_{min}$, $W_{total}$ and D are given:

$$A = \sum_{n=1}^{N+1} K(n)\left(\log\frac{r_o(n)}{r_i(n)}\right)^{-1} \tag{5}$$

where K(1)=0.5; K(n)=2 when n≧2; $r_i(1)=r_{min}$; $r_i(n+1)-r_o(n)=D$; and $r_o(N+1)-r_i(1)=W_{total}$.

* * * * *